US007637236B2

(12) United States Patent
Ochiai et al.

(10) Patent No.: US 7,637,236 B2
(45) Date of Patent: Dec. 29, 2009

(54) CYLINDER HEAD FOR AN OVERHEAD-CAM INTERNAL COMBUSTION ENGINE, ENGINE INCORPORATING SAME, AND VEHICLE INCORPORATING THE ENGINE

(75) Inventors: Shuichi Ochiai, Saitama (JP); Hidemichi Mori, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 164 days.

(21) Appl. No.: 12/008,775

(22) Filed: Jan. 14, 2008

(65) Prior Publication Data

US 2008/0178829 A1 Jul. 31, 2008

(30) Foreign Application Priority Data

Jan. 31, 2007 (JP) ..... 2007-021224

(51) Int. Cl.
*F01M 1/06* (2006.01)

(52) U.S. Cl. ..... 123/90.33; 123/90.34; 123/90.38; 123/193.3; 29/888.06

(58) Field of Classification Search ..... 123/90.27, 123/90.31, 90.33, 90.34, 90.38, 193.3, 193.5, 123/195 C, 196 CP, 196 M, 198 E, 198 F; 29/888.06

See application file for complete search history.

(56) References Cited

U.S. PATENT DOCUMENTS 6,510,823 B2 1/2003 Hirano et al.
6,619,247 B2 * 9/2003 Kobayashi ..... 123/90.15

FOREIGN PATENT DOCUMENTS

JP 2002-089360 3/2002
JP 3547382 7/2004

* cited by examiner

*Primary Examiner*—Ching Chang
(74) *Attorney, Agent, or Firm*—Carrier, Blackman & Associates P.C.; William D. Blackman; Joseph P. Carrier

(57) ABSTRACT

In an internal combustion engine, a lubricated camshaft assembly is in a cam chamber formed between a cylinder head and a cylinder head cover. The cylinder head includes outer bolt-receiving holes in which selected head bolts are inserted, and which are outside of the cam chamber. An oil discharge passage in the cylinder head has an inlet opened into the cam chamber, and an outlet opened into an outer bolt-receiving hole. The inlet of the oil discharge passage is disposed on one lateral side of the cam chamber. An opening part of a timing chamber is on the other lateral side of the cam chamber. An endless loop timing chain or belt is disposed inside of the timing cover, for transmitting the power of a crankshaft to the camshaft. A vehicle, which may be a four-wheeled all-terrain vehicle, may incorporate the engine and cylinder head as described.

19 Claims, 19 Drawing Sheets

CYLINDER HEAD FOR AN OVERHEAD-CAM INTERNAL COMBUSTION ENGINE, ENGINE INCORPORATING SAME, AND VEHICLE INCORPORATING THE ENGINE

CROSS-REFERENCE TO RELATED APPLICATIONS

The present invention claims priority under 35 USC §119 based on Japanese patent application No. 2007-021224, filed on Jan. 31, 2007. The entire disclosure of this priority document, including specification, claims, and drawings, is incorporated by reference herein.

BACKGROUND OF THE INVENTION

1. Technical Field of the Invention

The present invention relates to an improved cylinder head for an overhead-cam internal combustion engine, where the cylinder head has an improved oil passage structure formed therein. The invention also relates to an engine including the improved cylinder head along with a valve actuating mechanism, maintained in an oil bath in a cam chamber defined between the cylinder head and a cylinder head cover. The invention also relates to a vehicle incorporating such an internal combustion engine.

2. Background Art

A number of known designs exist for overhead-cam type internal combustion engines, in which a camshaft assembly, disposed in a cam chamber defined between a cylinder head and a cylinder head cover, is operative to selectively operate intake and exhaust valves, respectively. For example, there has been known an overhead-cam internal combustion engine wherein some of the head bolts, used for coupling the cylinder head and the cylinder block, are disposed outside of the cam chamber (refer, for example, to Japanese Patent No. 3547382, FIGS. 2 and 4).

In the overhead-cam internal combustion engine of this reference, the cam chamber and a space outside the cam chamber (for example, the crank chamber) communicate with each other through a timing chamber in which part of the valve train assembly is disposed. In addition, the valve train assembly includes such a torque transmission part as a timing chain for transmitting the power of the crankshaft to the camshaft in a camshaft assembly of the overhead camshaft type, and a push rod in a camshaft assembly of the push rod type.

Therefore, in the cam chamber, the lubricating oil, having lubricated the camshaft assembly and other members, flows through the timing chamber, to be discharged from the cam chamber outside of the cam chamber. In the cam chamber, however, in areas other than the vicinity of the area where the timing chamber is opened, the lubricating oil is not easily discharged from the cam chamber. In four-wheeled vehicles and similar vehicles, arranged such that the vehicle body is less frequently inclined at a lateral angle as compared with two-wheeled vehicles such as motorcycles, lubricating oil, which has been collected in the cam chamber, is not easily discharged through the timing chamber.

As a result, it is sometimes difficult for the thus-collected lubricating oil to be circulated smoothly in a lubricating oil circulation system composed of an oil pump, an oil passage structure including plural oil galleries, and the like. Therefore, the collected lubricating oil is heated by the combustion heat, which accelerates deterioration of the lubricating oil. In addition, due to the stagnation of the lubricating oil, the effective amount of heat exchange with the cylinder head is reduced, which leads to a lowering in the cooling effect of the lubricating oil.

Further, in the case where a cylinder head, in which the cam chamber is reduced in size by arranging head bolt outside the cam chamber, is to be provided with an oil discharge passage other than the timing chamber, the oil discharge passage must be arranged at such a position as to avoid interference with the intake valve, the exhaust valve and the like members provided in the cylinder head or with the space formed in the cylinder head (for example, the intake port, the exhaust port and, further, the water jacket). Due to the need to secure a space for realizing this arrangement, the cam chamber and, hence, the cylinder cover and the cylinder head cover must remain relatively large in size, which adversely affects the intended size reductions of these components.

SUMMARY OF THE INVENTION

The present invention has been made in consideration of the above-mentioned circumstances. Accordingly, it is an object of the present invention, in a number of aspects hereof, to simultaneously reduce the size of a cam chamber and a cylinder head.

It is another object of the present invention to efficiently discharge lubricating oil from the cam chamber, in an overhead-cam internal combustion engine having a camshaft assembly lubricated in the cam chamber.

In addition, it is another object of the present invention, in the case where the internal combustion engine is mounted on a vehicle, to efficiently discharge lubricating oil at both lateral ends of the cam chamber in the vehicle width direction.

In a first aspect of the present invention, an overhead-cam internal combustion engine includes: a crankcase forming a crank chamber for disposing a crankshaft therein; a cylinder block having at least one cylinder; a cylinder head fastened to the crankcase or the cylinder head by a head bolt; a cylinder head cover connected to the cylinder head; and a camshaft assembly including a camshaft for selectively opening and closing intake and exhaust valves provided in the cylinder head; the camshaft assembly being lubricated with a lubricating oil in a cam chamber defined by the cylinder head and the cylinder head cover, wherein the cylinder head is provided with a bolt-receiving hole in which the head bolt is inserted and which is not opened into the cam chamber, and with an oil discharge passage having an inlet opened into the cam chamber and an outlet opened into the bolt-receiving hole.

In a second aspect of the present invention, the overhead-cam internal combustion engine according to the first aspect is further modified so that the cylinder axis of the cylinder is inclined in a predetermined direction relative to a vertical line, and the inlet is disposed in a region on the side of the predetermined direction with respect to the cylinder axis.

In a third aspect of the present invention, the overhead-cam internal combustion engine according to the second aspect is mounted in a vehicle, wherein the camshaft is disposed in the cam chamber and rotatably supported by the cylinder head, an opening part of a timing chamber in which to dispose a transmission part for transmitting power of the crankshaft to the camshaft is opened into the cam chamber, the predetermined direction is the forward direction, the inlet is disposed at an end part on one side of the cam chamber in the vehicle width direction, and the opening part is disposed at an end part on the other side of the cam chamber in the vehicle width direction.

In a fourth aspect of the present invention, the overhead-cam internal combustion engine according to the first aspect is further modified such that a single camshaft is provided in the camshaft assembly while being rotatably supported by the cylinder head, and the bolt-receiving hole is disposed on the side on which the exhaust valve is located, relative to the rotary axis of the camshaft and the intake valve, in a direction orthogonal to the rotary axis, as viewed from the cylinder axis direction, and are disposed on the outside of the cam chamber.

According to the first aspect hereof, the oil discharge passage is provided in the cylinder head so as to communicate with the bolt-receiving hole by utilizing the bolt-receiving hole, which is provided in the cylinder head, in which the head bolt is inserted and which is not opened into the cam chamber. Therefore, the passage length of the oil discharge passage is short, and it is unnecessary to secure a large space in the cylinder head for the purpose of providing the oil discharge passage, so that the oil discharge passage can be easily provided in an area, where the lubricating oil is collected, in the cam chamber.

As a result, since the head bolt is not disposed inside the cam chamber, it is possible to enhance the performance of discharge of the lubricating oil present in the cam chamber by utilizing the oil discharge passage and to thereby prevent the lubricating oil from collecting in the cam chamber, while reducing the sizes of the cam chamber, the cylinder head and the cylinder head cover.

According to the second aspect hereof, since the cylinder axis is inclined to a predetermined direction relative to a vertical line, the inlet of the oil discharge passage is disposed in a region on the side of the predetermined direction, which is located on the more lower side as compared with the case where the cylinder axis is parallel to the vertical line; therefore, it becomes easier for the lubricating oil in the cam chamber to flow into the oil discharge passage.

As a result, by disposing the cylinder block so that the cylinder axis is inclined to the predetermined direction relative to the vertical line, it is possible to further enhance the performance of discharge of the lubricating oil present in the cam chamber through the use of a simple structure, without complicating the shape of a chamber wall forming the bottom surface of the cam chamber.

According to the third aspect hereof, the inlet of the oil discharge passage and the opening part of the timing chamber are disposed respectively at both end parts in the vehicle width direction of the cam chamber; therefore, even in four-wheel vehicles and the like vehicles which are less liable to be inclined in the vehicle width direction, the performance of discharge of the lubricating oil is enhanced at both end parts in the cam chamber.

According to the fourth aspect hereof, the bolt-receiving hole or holes disposed outside the cam chamber are laid out on the side on which the exhaust valve is disposed, with reference to the rotary center line, as viewed from the cylinder axis direction, so that the layout is not limited by the camshaft. In addition, the valve diameter of the exhaust valve or the diameter of the exhaust aperture of the exhaust port is set smaller than the valve diameter of the intake valve or the diameter of an intake aperture of the intake port, whereby the cam chamber can be reduced in size in the vicinity of the exhaust valve, so that it is possible to achieve further reductions in size of the cam chamber, the cylinder head and the cylinder head cover.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION OF SELECTED ILLUSTRATIVE EMBODIMENTS

Now, a selected illustrative embodiment of the present invention will be described below, referring to FIGS. 1A to 17.

Referring to FIGS. 1A-1B and 2A-2B, an overhead-cam internal combustion engine E according to an illustrative embodiment of the present invention is shown operatively mounted on a vehicle V, which may be a small four-wheeled vehicle or saddle-type vehicle, for example, an all-terrain vehicle (ATV). In the depicted example, the engine E is mounted in a central portion of the vehicle's frame F. The internal combustion engine E constitutes a power unit for the vehicle V, combining the basic engine together in a single integrated unit with a power transmission system, including a clutch C and a transmission M.

The power generated by the internal combustion engine E is transmitted from a crankshaft 22 (FIGS. 2A-2B) of the internal combustion engine E through the clutch C and the transmission M to a drive shaft S connected to each of drive wheels.

Figure 1A:
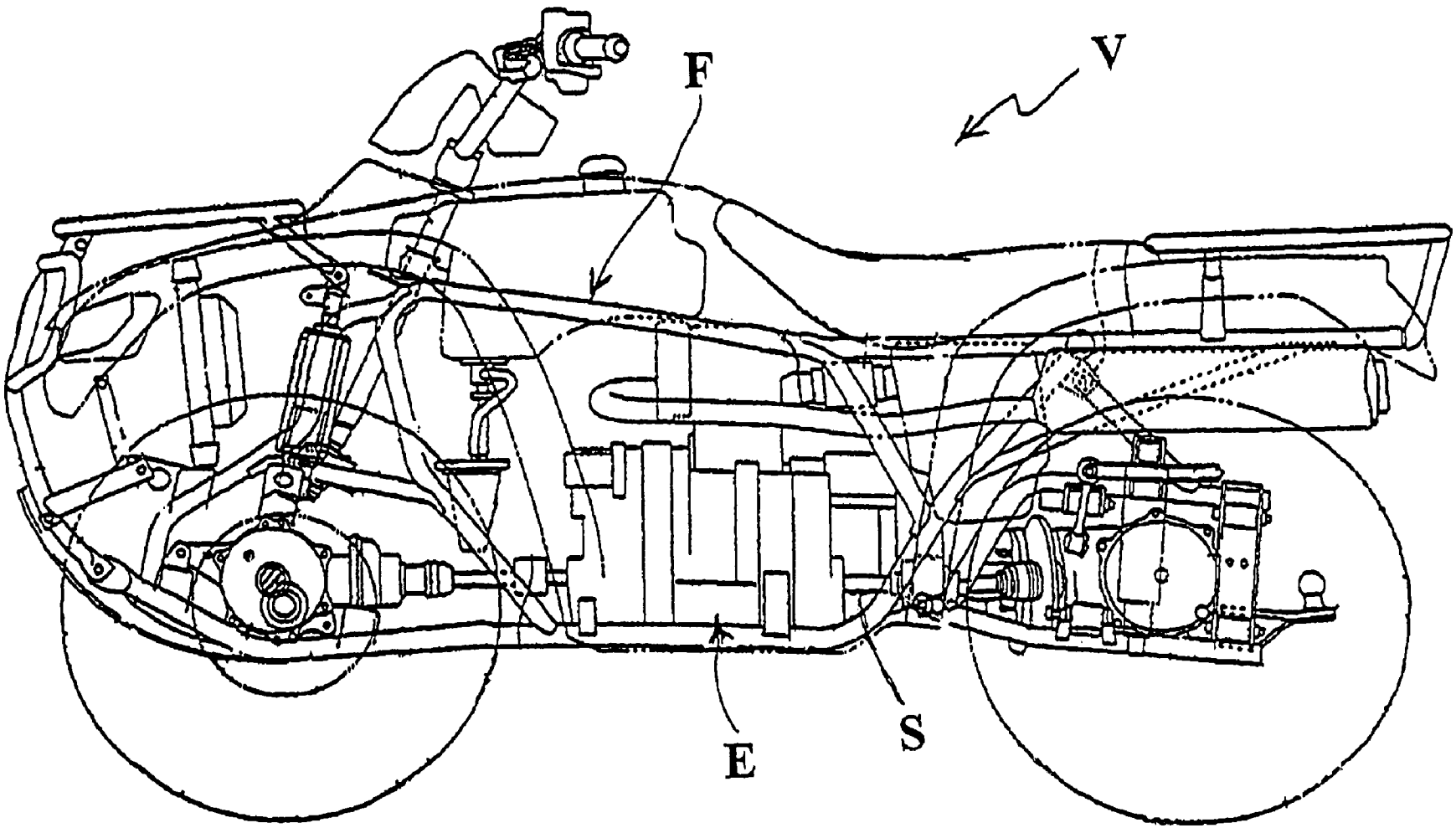
FIG. 1A is a side elevational view of a four-wheeled all-terrain vehicle having an overhead-camshaft-type engine according to an illustrative embodiment of the present invention mounted therein, with an exterior body cover removed for illustrative purposes.
Figure 1B:
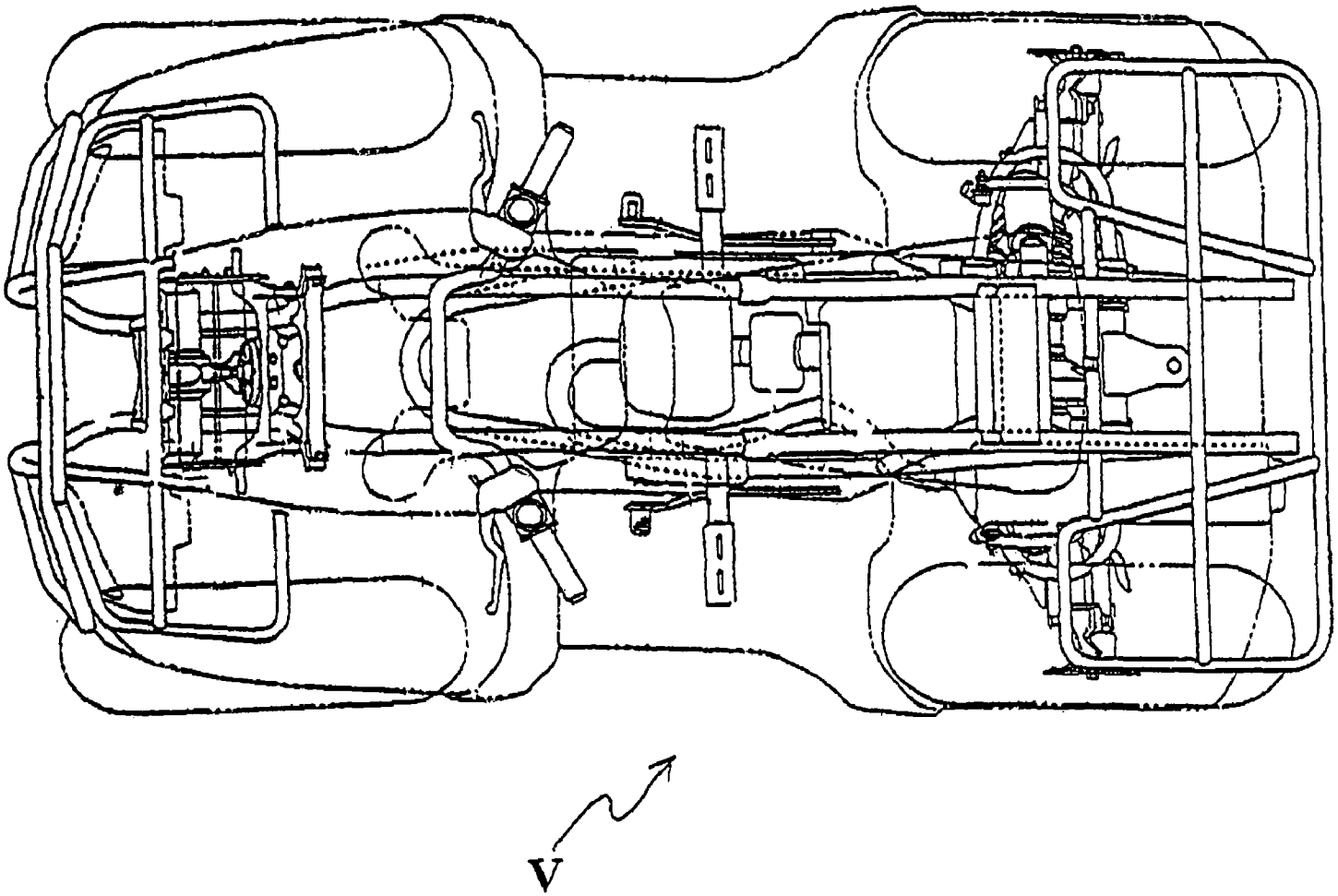
FIG. 1B is a top plan view of the vehicle of FIG. 1A.
Figure 2A:
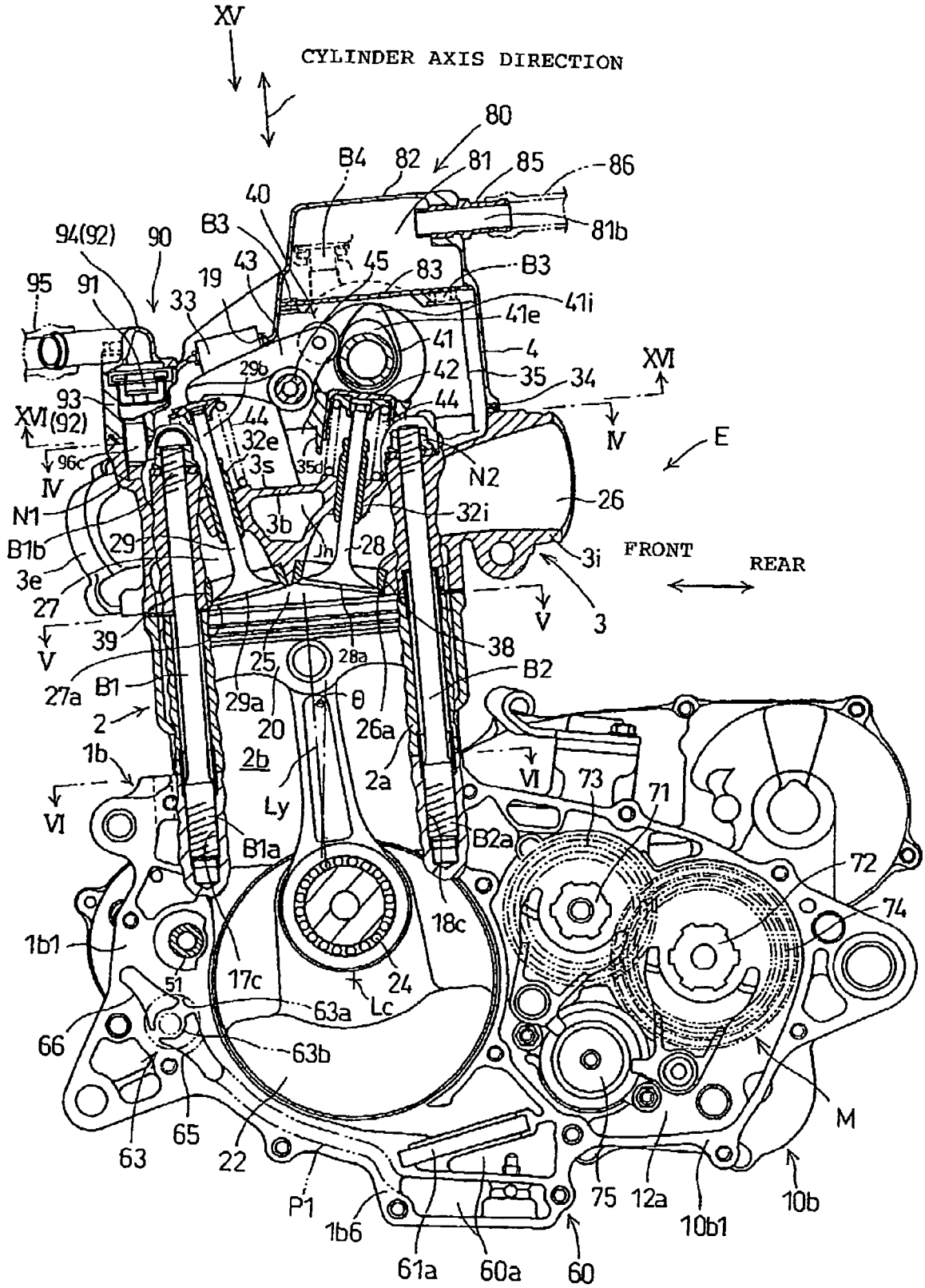
FIG. 2A is a partial sectional view of an overhead-cam internal combustion engine according to an illustrative embodiment of the present invention, taken along a substantially vertical plane containing a connecting surface of a crankcase, and orthogonal to the rotary center line Lc of a crankshaft.
Figure 2B:
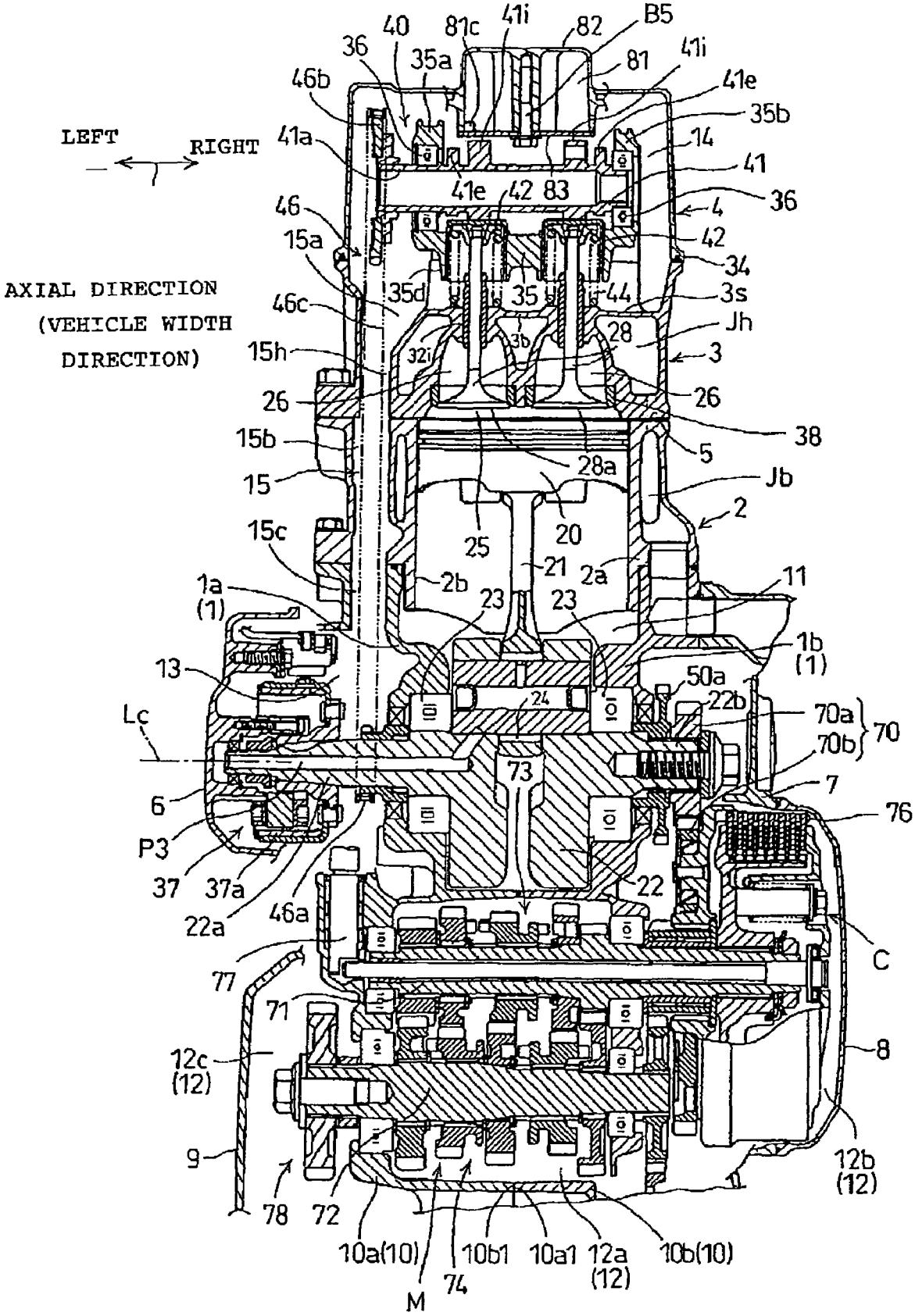
FIG. 2B is a sectional view of the power system of FIG. 2A, taken substantially along a plane passing through an intake valve, a cylinder axis, the rotary center line of the crankshaft, and the rotary center lines of a main shaft and a counter shaft of a transmission.

More specifically, as shown in FIGS. 2A-2B, the power transmission system disposed in a transmission case 12 formed by a transmission case 10 and various covers 7, 8, 9 includes a primary speed reduction mechanism 70 for transmitting the power of the crankshaft 22 to the clutch C, the clutch C of the multiple-disk frictional type, the transmission M of the normally meshed gear type, the above-mentioned drive shaft S, and a gear mechanism 78 for transmitting the output of the transmission M to the drive shaft.

The primary speed reduction mechanism 70 disposed in a clutch chamber 12*b* includes a drive gear 70*a* provided on the crankshaft 22, and a driven gear 70*b* provided on the clutch C. The transmission M is disposed in the transmission chamber 12*a* on the rear side of the crankshaft 22. The transmission M includes a main shaft 71 and a counter shaft 72 which are provided with a main gear group 73 and a counter gear group 74, respectively, and a speed change selection mechanism having a shift drum 75 operated by a speed change operation mechanism.

The clutch C, provided at a shaft end part of the main shaft 71 and disposed in the clutch chamber 12*b*, includes a multiplicity of clutch disks 76. When operated by a clutch operating mechanism 77, the clutch C functions to transmit or to interrupt the transmission of power from the crankshaft 22 to the transmission M.

Therefore, it will be apparent that the rotary torque of the internal combustion engine E is transmitted from the crankshaft 22 through the primary speed reduction mechanism 70 and the clutch C to the transmission M. An output torque, obtained after speed change in the transmission M, is transmitted from the counter shaft 72 through the gear mechanism 78 to the drive shaft S, and it is further transmitted through a secondary speed reduction mechanism (not shown in detail) to each of the drive wheels.

In the depicted embodiment, the internal combustion engine E is a single-cylinder four-stroke water-cooled internal combustion engine having an engine body, which includes a crankcase 1, a cylinder block 2, a cylinder head 3 and a cylinder head cover 4, as will be further described herein. The crankcase 1 forms a crank chamber 11, in which a crankshaft 22 is rotatably mounted on a pair of main bearings 23. The crankshaft 22 has a rotary center line Lc (FIG. 2A) set in the left-right direction, i.e., the vehicle width direction of the vehicle V.

Also in the depicted embodiment, the cylinder block 2 has a single cylinder 2*a*, and the cylinder head 3 is sealably connected to an upper part of the cylinder block 2, through a gasket 5, by outer head bolts B1 and B2. The cylinder head cover 4 is connected to an upper part of the cylinder head 3 using appropriate fasteners.

In the following description, the terms front, rear, left, right, upper and lower as used with reference to the engine E coincide with the front, rear, left and right sides with reference to the vehicle V. In addition, the direction of the rotary center line (axis) of the crankshaft 22 or the direction of the rotary center line (axis) of the camshaft 41 (which is parallel to the crankshaft), may be referred to as the axial direction.

In this embodiment, the engine E is mounted transversely on the vehicle frame F, so that the axial direction coincides with the vehicle width direction and also with the left-right direction. In addition, when one of the left and right sides is taken as one side in the axial direction, the other of the left and right sides is taken as the other side in the axial direction.

As shown in FIGS. 2A and 2B, the crankcase 1, connected to a lower part of the cylinder block 2, includes a left case 1*a* and a right case 1*b*. The crankcase 1 is bisected into the left and right cases 1*a*, 1*b* along a plane which coincides with the cylinder axis Ly. The plane which bisects the crankcase 1 is also orthogonal to the rotary center line Lc of the crankshaft, which extends in the axial direction. In this instance, the left case 1*a* and the right case 1*b* are connected to each other by bolts, in the condition where their mating surfaces 1*a*1, 1*b*1 (see FIGS. 6 and 14, also) are smoothly machined and are matingly aligned with each other. The left case 1*a*, and a left crankcase cover 6 bolted to the left side of the left case 1*a*, cooperate to form an accessory chamber 13, as a space adjacent and outside of the crank chamber 11. Similarly, the right case 1*b*, a right crankcase cover 7 bolted to the right case 1*b*, and a right transmission case 10*b* (described later), and a clutch cover 8 connected to the right crankcase cover 7 cooperate to form the clutch chamber 12*b*.

The transmission case 10, forming the transmission chamber 12*a* in which the transmission M is disposed, includes a left transmission case 10*b* and the right transmission case 10*b*, which are formed integrally with the left case 1*a* and the right case 1*b*, respectively, and which are connected to each other by bolts in the condition where their mating surfaces 10*a*1, 10*b*1 are smoothly machined and are mated to each other. The respective mating surfaces 1*a*1 and 10*a*1 are both located in one plane, whereas the other mating surfaces 1*b*1 and 10*b*1 are located in another plane. In addition, the left transmission case 10*b* and the cover 9 connected to the left transmission case 10*b* form a gear chamber 12*c*.

The transmission case 12 includes the transmission chamber 12*a*, the clutch chamber 12*b* and the gear chamber 12*c*. The crank chamber 11 and the transmission case 12 are chambers independent from each other, and circulation of a lubricating oil between the crank chamber 11 and the transmission case 12 is interrupted.

The cylinder 2*a* has the cylinder axis Ly (FIG. 2A) which extends upward and which is slightly inclined toward the front side at a predetermined angle θ as shown. In other words, the cylinder axis Ly is inclined in a predetermined forward angular direction in relation to a vertical line.

A piston 20 is slidably and reciprocatably fitted in a cylinder bore 2*b*, formed in the cylinder 2*a*. The piston 20 is connected to the crankshaft 22 through a connecting rod 21. The crankshaft 22 is rotatably supported in the crankcase 1 through the main bearings 23, which are respectively held by the left case 1*a* and the right case 1*b*.

Referring also to FIGS. 3-6, the cylinder head 3 is fastened to the crankcase 1 together with the cylinder block 2, by a plurality of (in this embodiment, four) head bolts, where each of the head bolts is classified as an external head bolt B1 or as an internal head bolt B2. The head bolts B1, B2 are stud bolts in the depicted embodiment, and are disposed at substantially regular intervals around the periphery of the cylinder bore 2*b*, arranged around the circumference thereof. In this way, the cylinder head 3 is fastened to the cylinder block 2 and, hence, is fastened to the crankcase 1 through the cylinder block 2, by the outer head bolts B1, B2.

The outer head bolts B1, B2 are provided with threaded screw parts B1*a*, B1*b*, B2*a*, B2*b* at their opposite lower and upper end parts, respectively. These screw parts are inserted in bolt-receiving holes 17*b*, 18*b*, 17*h*, 18*h* formed in the cylinder block 2 and the cylinder head 3, with the screw parts B1*a*, B2*a* in screw engagement with screw holes 17*c*, 18*c* provided in the crankcase 1. The screw holes 17*c*, 18*c* and the bolt-receiving holes 17*b*, 18*b*, 17*h*, 18*h* may also be described as bolt-receiving holes 17, 18 in which to inset the outer head bolts B1, B2, respectively.

Therefore, in the condition where the crankcase 1, the cylinder block 2 and the cylinder head 3 are connected integrally, the outer head bolts B1, B2 are inserted in the screw holes 17*c*, 18*c*, 17*b*, 18*b*, 17*h*, 18*h* and the bolt-receiving holes 17*c*, 18*c*, 17*b*, 18*b*, 17*h*, 18*h*. Here, a combination of one of the outer head bolts B1, B2 with one of nuts N1, N2 brought into screw engagement with the screw parts B1*b*, B2*b* of the outer head bolts B1, B2 constitutes a single cylinder head-connecting fastener.

A cam chamber 14 (FIG. 2B) is defined between the cylinder head 3 and the cylinder head cover 4. The camshaft 41 is rotatably supported in the cam chamber 14 by bearings 36 at each end thereof. The outer head bolts B1 are disposed entirely outside of the cam chamber 14, while portions of the inner head bolts B2 are situated inside of the cam chamber 14. This will be explained in further detail. Of all the outer head bolts B1, B2 and the nuts N1, N2, the outer head bolts B1 as outside head bolts, and the nuts N1 composed of cap nuts as outside nuts, are disposed outside of the cam chamber 14. The screw parts B2*b* constituting parts of the inner head bolts B2, as inside head bolts, and the whole of the nuts N2 as inside nuts, are disposed inside of the cam chamber 14. However, the outer cylinder head-connecting fasteners, composed of the outer head bolts B1 and the nuts N1, are disposed entirely outside of the cam chamber 14, whereas parts of the inner cylinder head-connecting fasteners, including the inner head bolts B2 and the nuts N2, are disposed inside of the cam chamber 14.

Figure 4:
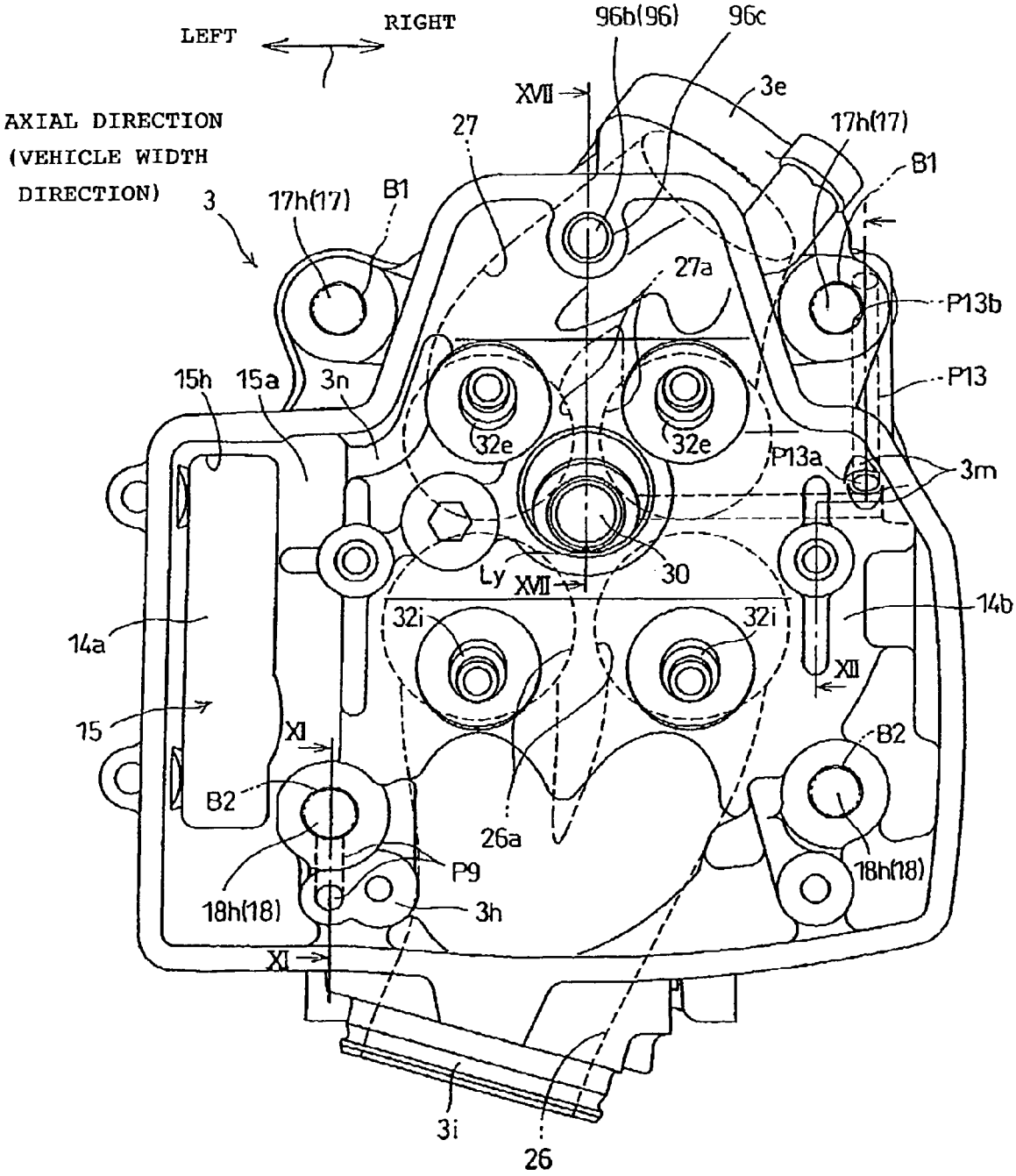
FIG. 4 is a view of the cylinder head as viewed from the cylinder axis direction, taken along arrows IV-IV of FIG. 2A.

As seen in FIG. 4, the outer bolt-receiving hole 17*h* penetrates the cylinder head 3 outside of the cam chamber 14. Therefore, the outer bolt-receiving hole 17*h* is not in communication with the cam chamber 14. In contrast, the inner bolt-receiving hole 18*h* penetrates the cylinder head 3 so as to open into the cam chamber 14.

Referring now to FIGS. 2A, 2B and 4, the cylinder head 3 is provided with a combustion chamber 25 opposed to the piston 20 in the cylinder axis direction. The cylinder head 3 also includes an intake port 26 having a pair of intake apertures 26*a* opened into the combustion chamber 25, a pair of intake valves 28 provided for opening and closing the corresponding intake apertures 26*a*, an exhaust port 27 having a pair of exhaust apertures 27*a* opened into the combustion chamber 25, and a pair of exhaust valves provided for opening and closing the pair of exhaust apertures 27*a*. The intake valves 28 and the exhaust valves 29 are slidably supported by valve sleeves 32*i*, 32*e* integrally provided in the cylinder head 3. The valves 28, 29 are selectively driven by a valve train 40 provided in the cam chamber 14 of the internal combustion engine E, to open and close the intake port 26 and the exhaust port 27 synchronously with the rotation of the crankshaft 22.

A spark plug 31 (see FIG. 17) is attached to a spark plug mounting hole 30 adjacent the combustion chamber 25, and the cylinder head 3 has a head-side water jacket Jh formed therein and communicating with a block-side water jacket Jb (see FIG. 5 also) provided for the cylinder block 2, in correspondence with the cylinder 2*a*. The spark plug 31 is accommodated in an accommodating tube 33 which is fixed to the cylinder head 3 and which penetrates, in a sealed gas-tight condition, an accomodating hole 19 (also see FIG. 15) provided in the cylinder head cover 4.

Referring now to FIGS. 2A through 6, the valve train 40 is disposed in the cam chamber 14 defined between the cylinder head 3 and the cylinder head cover 4, and extends into a timing chamber 15, which is formed over the range of the cylinder head 3, the cylinder block 2 and the crankcase 1. The cylinder head 3 constitutes a head-side chamber wall surrounding the cam chamber 14. The head-side chamber wall includes: a bottom wall 3*b* composed of an upper deck of the cylinder head 3, and a raised peripheral wall 3*c* formed to rise up from the bottom wall 3*b* and having a connection surface 3*d* to which the cylinder head cover 4 is connected through a seal member 34.

The timing chamber 15 communicates with the cam chamber 14 by being opened at an opening part 15*a* in a bottom surface 3*s* formed by the bottom wall 3*b* in the cam chamber 14. The timing chamber 15 includes: spaces 15*h*, 15*b*, 15*c* (see FIGS. 5 and 6, also) composed of cavities provided in the cylinder head 3, the cylinder block 2 and the left case 1*a*, respectively. The timing chamber 15 opens into and communicates with the accessory chamber 13. In addition, the timing chamber 15 may be defined by a timing cover, attached to at least a part of the cylinder head 3, the cylinder block 2 and the left case 1*a*, respectively. A large part of the timing chamber is defined between the timing cover and the cylinder head 3, the cylinder block 2 and the left case 1*a*.

The valve train 40, of the single overhead cam (SOHC) type, provides a valve driving mechanism including a single camshaft 11 for selectively opening and closing the intake valves 28 and the exhaust valves 29, respectively, by being driven to rotate in synchronization with the crankshaft 22. The valve train 40 also includes valve lifters 42 and rocker arms 43 as cam followers, driven respectively by intake cam lobes 411 and exhaust cam lobes 41*e* provided on the camshaft 41; and valve springs 44 for normally biasing the intake valves 28 and the exhaust valves 29 in the valve-closing direction.

The valve driving mechanism includes the camshaft 41 rotatably supported by the cylinder head 3 through a bearing 36 held at a bearing parts 35*a*, 35*b* of a cam holder 35, and a timing chain and gear set 46 for transmitting the power of the crankshaft 22 to the camshaft 41. The cam holder 35, disposed in the cam chamber 14, is integrally composed of a single member, and is connected to the cylinder head 3 by a plurality of bolts B3. In addition, the bearing parts 35*a*, 35*b* are provided with screw holes 35*c* into which a pair of bolts B4 (see FIG. 2A) are screwed for fastening the cylinder head cover 4 to the cam holder 35. Therefore, the cylinder head cover 4 is connected to the cylinder head 3 through the cam holder 35, by the bolts B4 inserted in bolt-receiving holes 4*a* (see FIGS. 15 and 16).

The camshaft 41, disposed in the cam chamber 14, is driven to rotate by the power of the crankshaft 22 transmitted through the timing chain and gear set 46, and has a rotary center line La parallel to the rotary center line Lc of the crankshaft 22. The intake cam lobes 41*i* make sliding contact with the valve lifters 42, whereas the exhaust cam lobes 41*e* make sliding contact with the rocker arms 43.

The timing chain and gear set 46 includes: a crank timing gear 46*a* (drive sprocket) as a drive rotating body provided at a shaft end part 22*a*, projecting leftward from the crank chamber 11 and located in the accessory chamber 13, of the crankshaft 22; a cam timing gear 46*b* (driven sprocket) as a driven rotating body provided at a shaft end part 41*a*, located on the left side relative to the bearing 36, of the camshaft 41; and a chain 46*c* as an endless transmission band wrapped around both the sprockets 46*a*, 46*b*. The cam timing gear 46*b* is disposed in the cam chamber 14, whereas most part of the chain 46*c* and the crank timing gear 46*a* are disposed in the timing chamber 15.

Therefore, the timing chain and gear set 46 including the chain 46*c* as a component member of the valve driving mechanism constituting the valve train 40 is disposed, as a torque-transmission part, in the timing chamber 15 opened into the cam chamber 14 at the opening part 15*a*. Since the camshaft 41, the valve lifter 42, the rocker arm 43 and the valve spring 44 are disposed in the cam chamber 14, the valve train 40 extends through both the cam chamber 14 and the timing chamber 15.

Each of the hollow cylindrical valve lifters 42 is slidably supported by a holding part 35*d*, which is formed integrally with the cam holder 35, and is driven by an associated intake cam lobe 41*i* to reciprocally slide, whereby the intake valves 28 are driven to open and close. On the other hand, each of the rocker arms 43 is supported by a rocker shaft 45 held by the cam holder 35, to be swingable about the swinging center line Lr, and are driven by an associated exhaust cam lobe 41*e* to swing, whereby the exhaust valves 29 are driven to open and close.

The outer diameter of a valve head 29*a* of the exhaust valve 29 and the diameter of the exhaust aperture 27*a* determined by a valve seat 39 for seating the valve head 29*a* are smaller than the outer diameter of a valve head 28*a* of the intake valve 28 and the diameter of the intake aperture 26*a* determined by a valve seat 38 for seating the valve head 28*a*. Both exhaust ports 27*a* and valve heads 29*a* are aligned along the axial direction, in the same manner as both intake ports 26*a* and valve heads 28*a*.

Intake air passing through an intake system (not shown) having an intake pipe attached to a side part 3*i* of the cylinder head 3 where the inlet of the intake port 26 is opened is mixed with a vaporized fuel supplied from a fuel-air mixture forming device such as a carburetor or fuel injector to form a fuel-air mixture, which is drawn through the intake port 26 and into the combustion chamber 25 in the intake stroke.

The fuel-air mixture is compressed in the combustion chamber during the compression stroke, in which the piston 20 is moved upward. The fuel-air mixture is then ignited by the spark plug 31 in the final period of the compression stroke, the fuel burns to create expanding gas, and the piston 20 is then driven downwardly by the pressure of the combustion gas during the expansion stroke, in which the piston 20 drives the crankshaft 22 to rotate. In the exhaust stroke, in which the piston 20 is moved upward, the combustion gas passes outwardly from the combustion chamber 25 into and through the exhaust port 27 as an exhaust gas, which is then routed to the exterior of the internal combustion engine E by passing through an exhaust system (not shown) having an exhaust pipe attached to a side part 3*e* of the cylinder head 3 where the outlet of the exhaust port 27 is opened.

Here, an intake passage includes a passage which is formed by the intake system and through which the intake air flows, and the intake port 26; similarly, an exhaust passage includes a passage which is formed by the exhaust system and through which the exhaust gas flows, and the exhaust port 27.

Referring to FIG. 2, an AC generator 37 as an accessory is disposed in the accessory chamber 13, and a rotor 37*a* of the AC generator 37 is provided at the shaft end part 22*a*.

Figure 7:
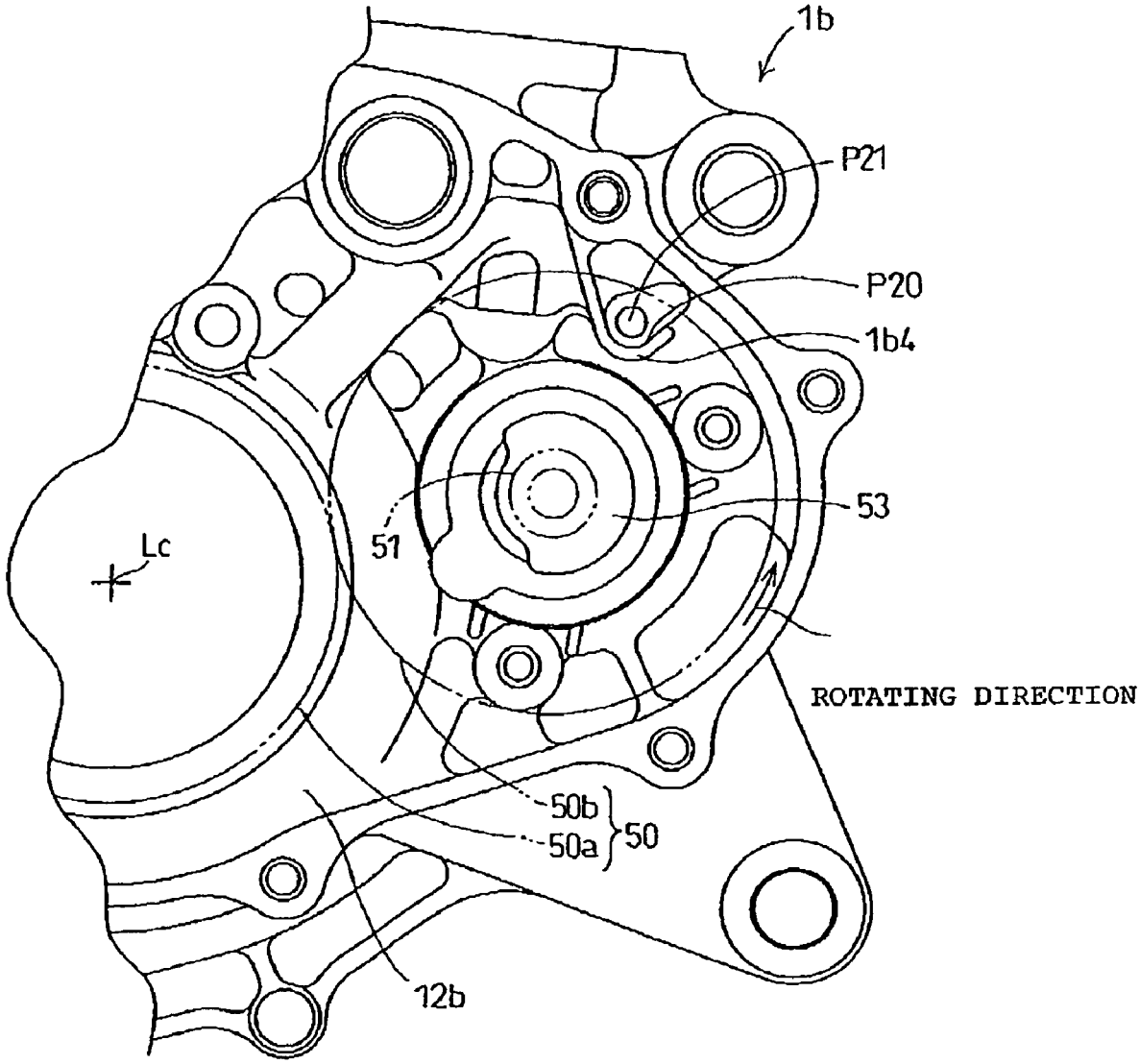
FIG. 7 is a right side detail view of a part of a right case of the crankcase in the internal combustion engine of FIG. 2A.
Figure 14:
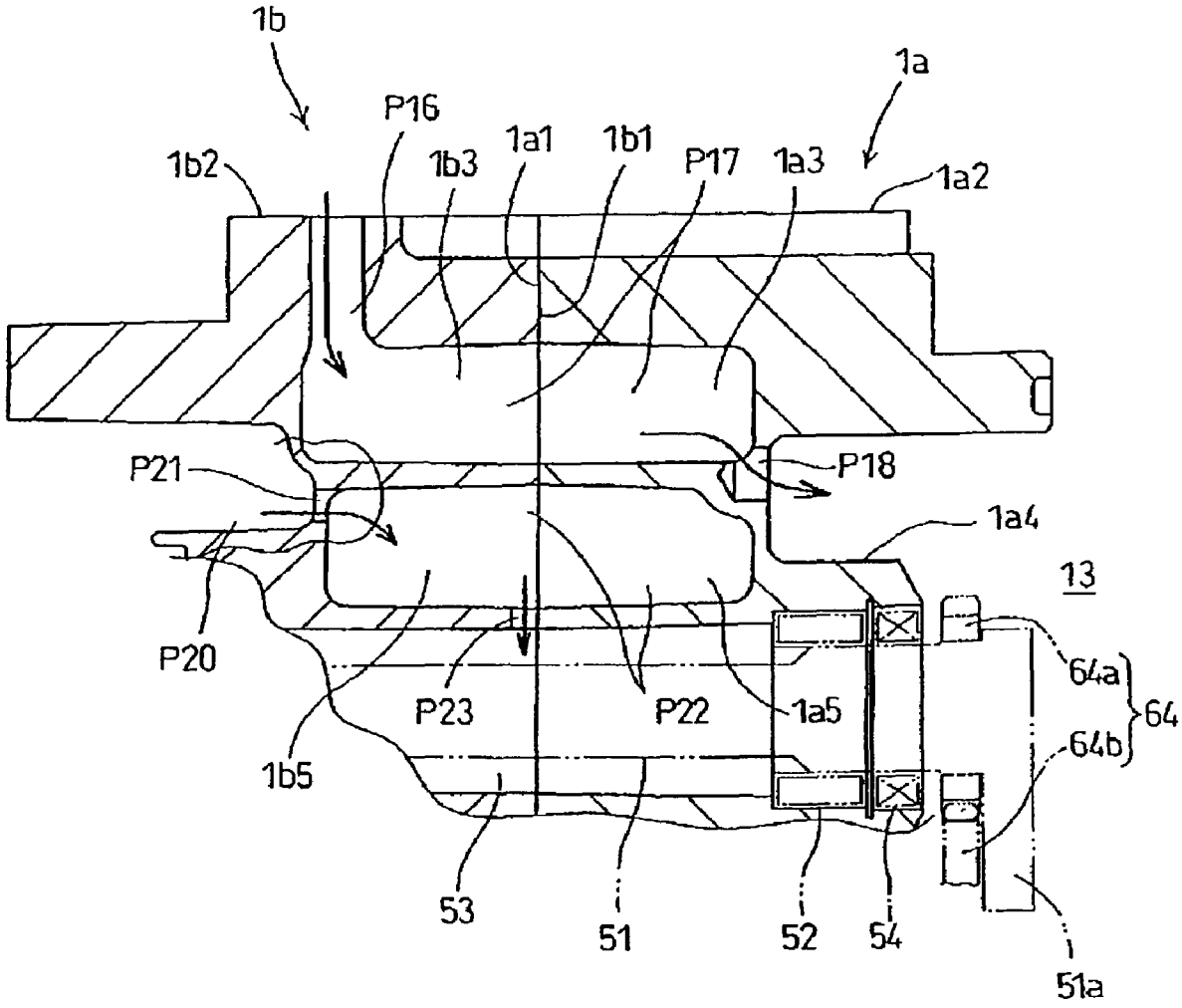
FIG. 14 is a sectional view taken along line XIV-XIV of FIG. 8.
Figure 15:
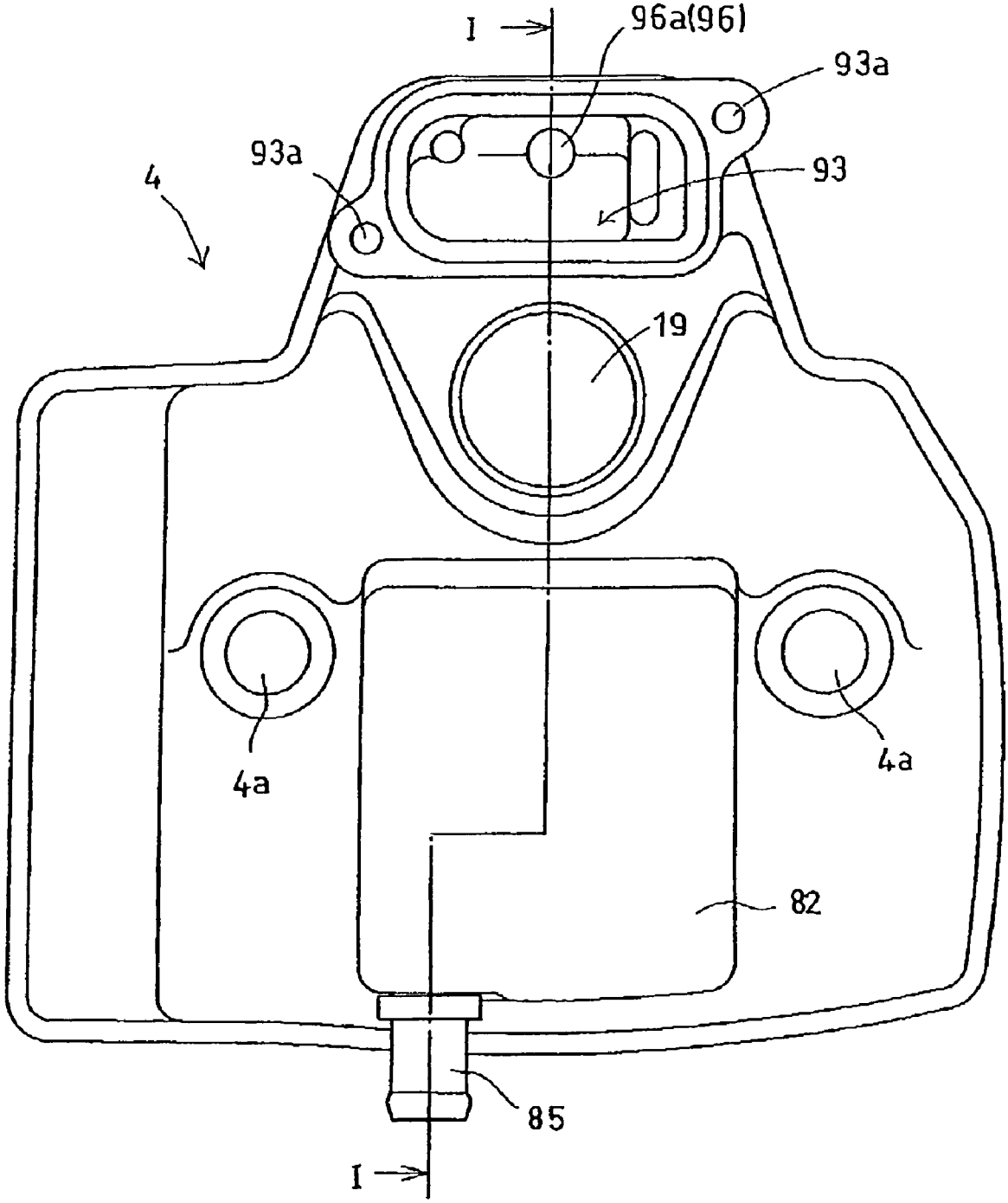
FIG. 15 is a view of the cylinder head cover as viewed from the cylinder axis direction, taken along arrow XV of FIG. 2A.

Referring to FIGS. 7 and 14 as well, a balancer drive gear 50*a* and a drive gear 70*a*, in this order from the crank chamber 11 side, are provided at a shaft end part 22*b*, projecting rightward from the crank chamber 11 and located in the clutch chamber 12*b*, of the crankshaft 22. The balancer drive gear 50*a* is meshed with a balancer driven gear 50*b*, which is provided at a right shaft end part of a balance shaft 51, provided as a rotating shaft rotatably supported by the left case 1*a* and the right case 1*b* through a pair of bearings 52 (the bearing 52 on the left side is shown in FIG. 14).

The balance shaft 51 is driven by the crankshaft 22 through a balancer driving mechanism 50, including the balancer drive gear 50*a* and the balancer driven gear 50*b*, to rotate at a speed equal to the rotating speed of, and in a direction reverse to the rotating direction of the crankshaft 22. The primary vibration generated by the reciprocating motion of the piston 20 is reduced by the operation of the balance shaft.

Referring again to FIG. 2A, a lubricating system, in which the lubricating oil is circulated, is provided for the internal combustion engine E and includes: an oil reservoir 60, which is provided at a bottom part of the crankcase 1 and in which the lubricating oil is collected; an oil pump 63 for circulating oil drawn in from the oil reservoir 60; and an oil passage structure composed of a plurality of oil passages or galleries (to be described later), through which the lubricating oil flows.

The oil reservoir 60 is formed over the range of the right case 1*b* and the left crankcase cover 6 with the left case 1*a* therebetween by their bottom parts (a bottom part 1*b*6 of the right case 1*b* is shown in FIG. 2A), and the lubricating oil is collected in the area ranging through the crank chamber 11 and the accessory chamber 13. The oil reservoir 60 includes a first oil reservoir 60*a* in which to reserve the lubricating oil in the crank chamber 11, and a second oil reservoir (not shown), in which to reserve the lubricating oil in the accessory chamber 13, and which communicates with the first oil reservoir 60*a*. A first oil strainer 61*a*, held by the left case 1*a* and the right case 1*b*, is disposed in the first oil reservoir 60*a*, and a second oil strainer (not shown), held by the left case 1*a* and the left crankcase cover 6, is disposed in the second oil reservoir.

The oil pump 63 as an accessory is a trochoid pump, which includes a pump rotor (not shown) forming a pump chamber accommodated in an accommodating chamber 63*a* (see FIG. 9, also) formed by the left case 1*a* serving as a pump body and the right case 1*b* serving as a pump cover, and a pump shaft 63*b* rotatably supported by the left case 1*a* and driving the pump rotor to rotate. The pump shaft 63*b* is driven to rotate by the power of the crankshaft 22 through an accessory driving mechanism 64 including a drive gear 64*a* (see FIG. 14) provided at a left shaft end part of the balance shaft 51 and a driven gear 64*b* (see FIG. 14) provided on the pump shaft 63*b*. A suction port 65 and a discharge port 66 of the oil pump 63 are provided in the connecting surface 1*b*1 of the right case 1*b*.

The left case 1*a* is provided with a suction oil passage P1 through which the lubricating oil sucked into the oil pump 63 is led from the first oil reservoir 60*a* into the suction port 65, and a discharge oil passage P2 for leading the lubricating oil discharged from the discharge port 66.

Figure 3:
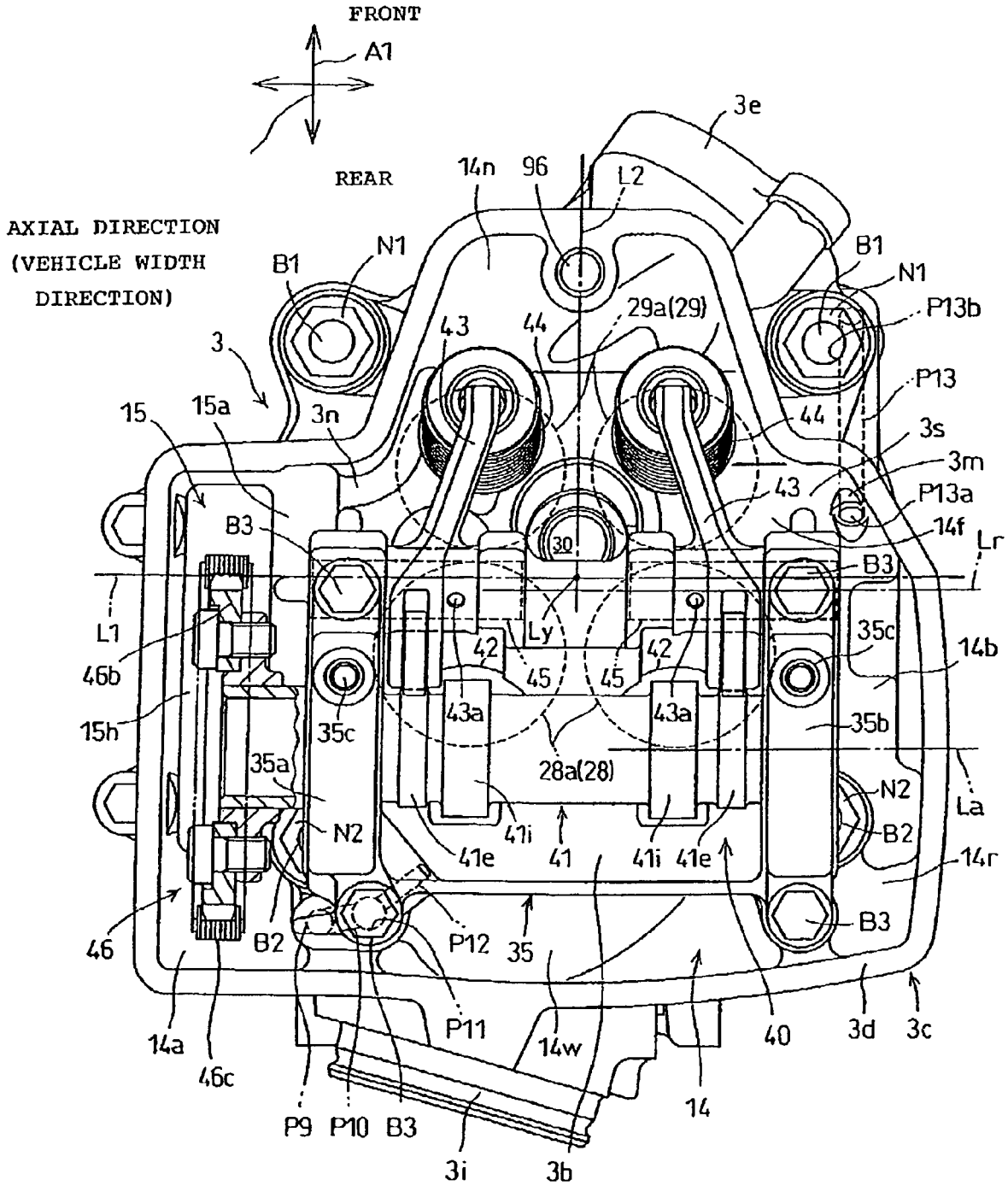
FIG. 3 is a detail view of a cylinder head and the power system, in the condition where the cylinder head cover of the internal combustion engine of FIG. 2A is removed.
Figure 12:
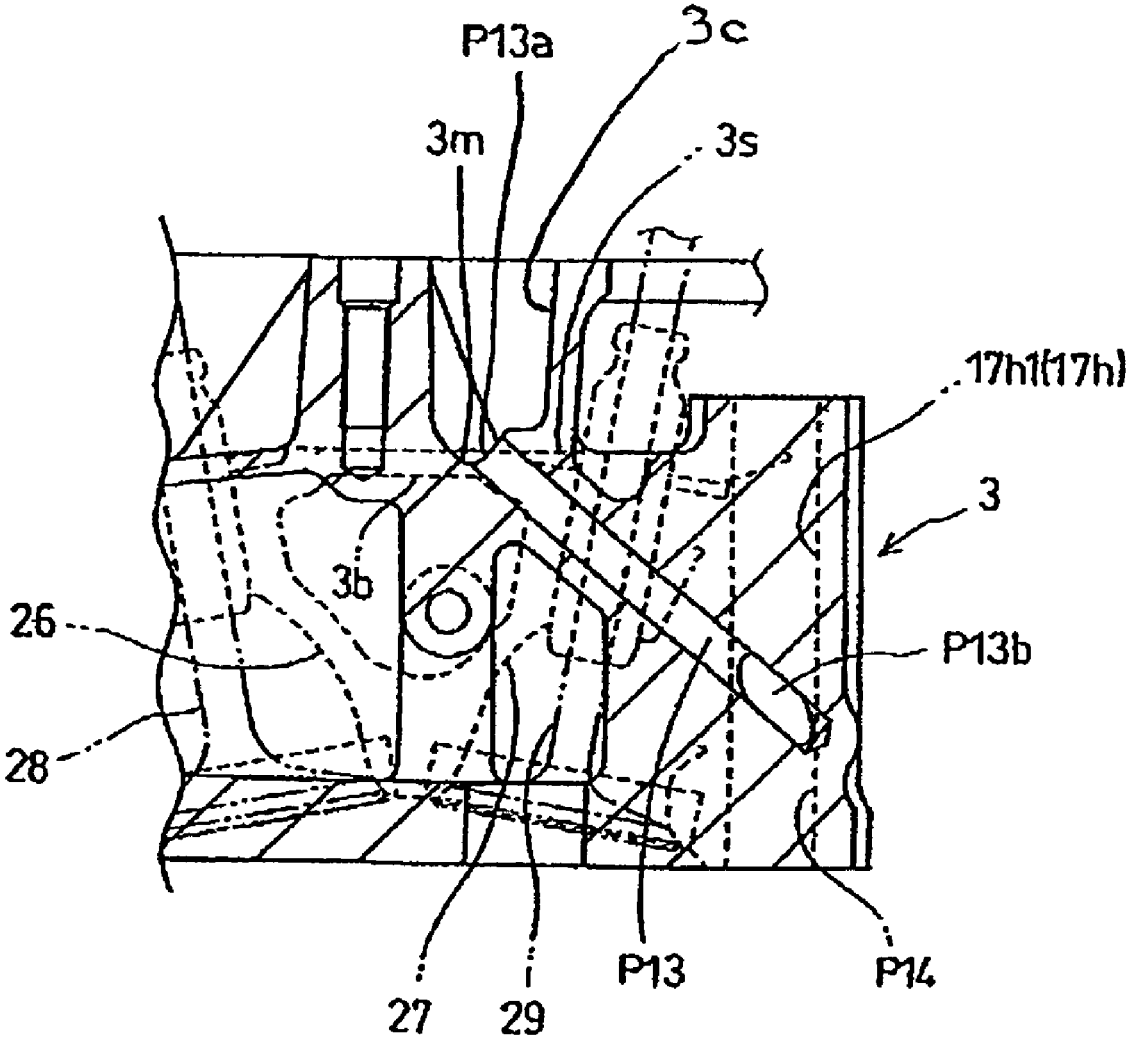
FIG. 12 is a sectional view taken along line XII-XII of FIG. 4.

Referring to FIGS. 3, 4 and 12, the cylinder head 3 is provided with an oil discharge passage P13, which has an inlet P13*a* opened in the bottom surface 3*s* into the cam chamber 14 and an outlet P13*b* opened into the outer bolt-receiving hole 17*h* not being opened into the cam chamber 14. The oil discharge passage P13 extends rectilinearly downwardly at a slope from the inlet P13*a* toward the front lower side, and is opened into the outer bolt-receiving hole 17*h*1 (see FIG. 12) nearer to the inlet P13*a*, of the two bolt-receiving holes 17*h* in which the two outer head bolts B1 are inserted respectively. As viewed from the cylinder axis direction, the oil discharge passage P13 extends in parallel to the front-rear direction, i.e., the direction A1 orthogonal to a specified straight line L1 which will be described later. In addition, the inlet P13*a* is opened into a recessed part 3*m* formed in the bottom surface 3*s*, and a groove 3*n* provided in the bottom surface 3*s* so as to extend while bending to the front side communicates with the opening part 15*a*.

Figure 16:
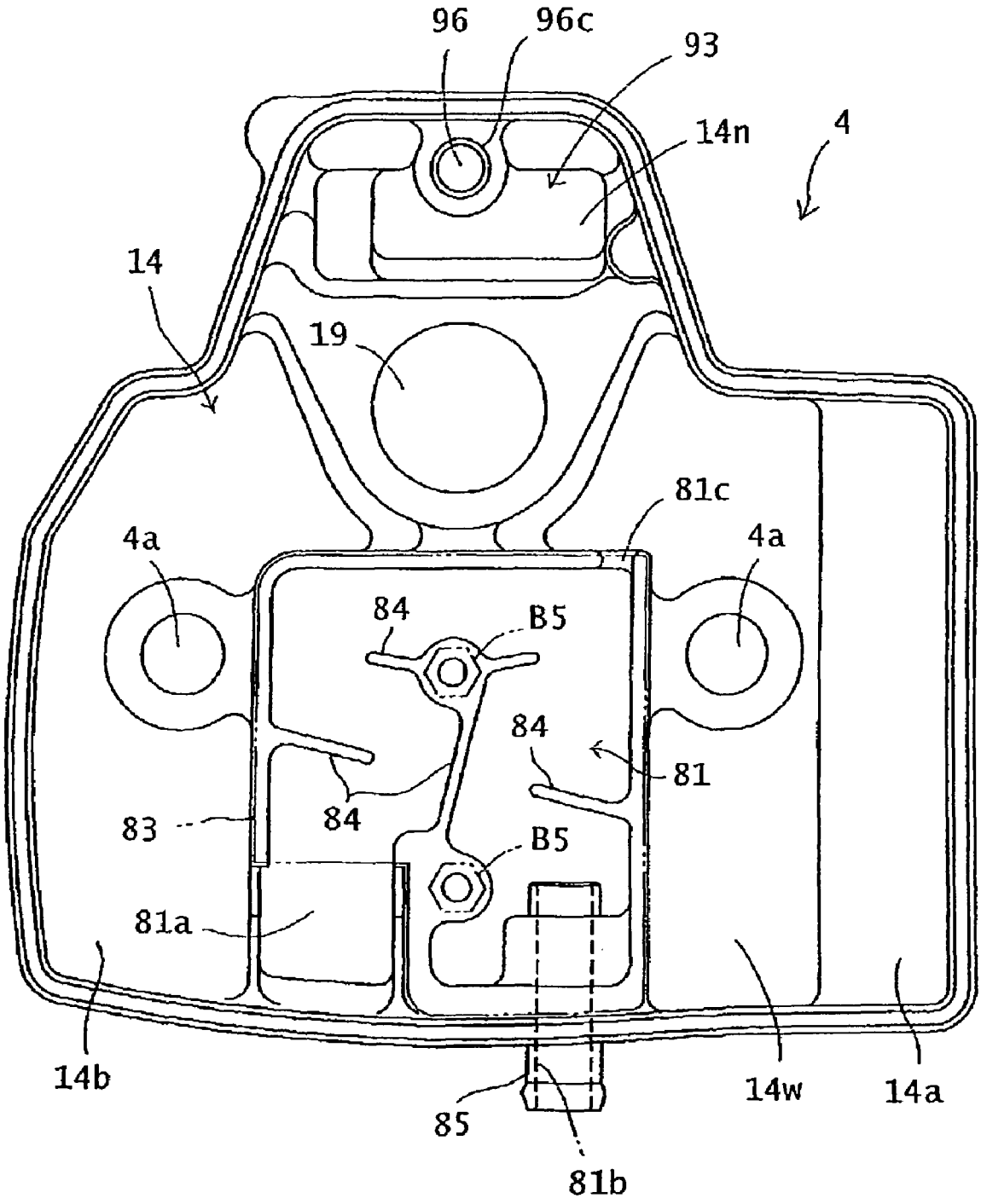
FIG. 16 is a view of the cylinder head as viewed from the cylinder axis direction, taken along arrows XVI-XVI of FIG. 2A.
Figure 17:
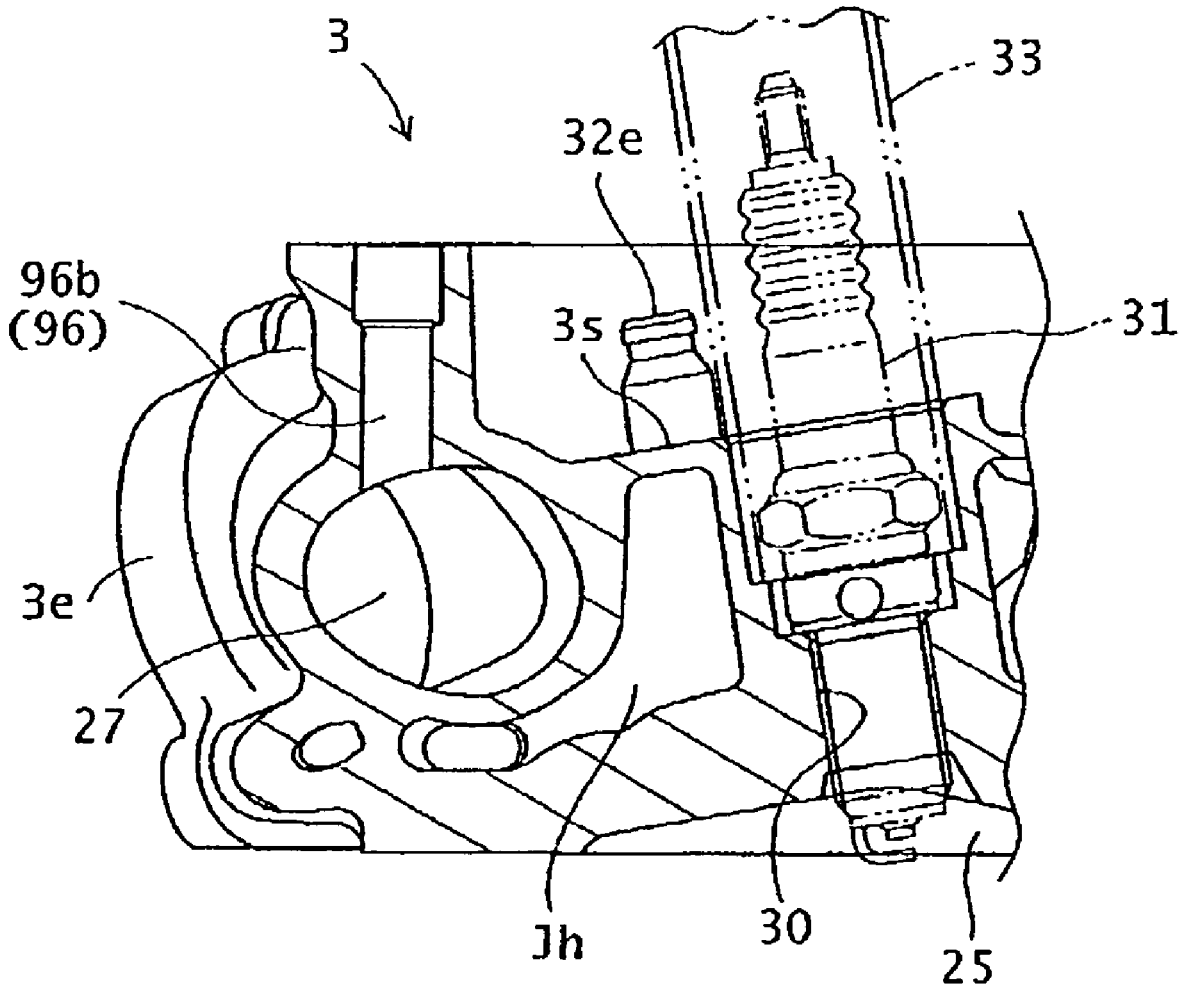
FIG. 17 is a sectional view taken along line XVII-XVII of FIG. 4.

As viewed from the cylinder axis direction, the cam chamber 14 has a wide part 14*w* of which the width in the axial direction is larger than the interval in the axial direction between the outer head bolts B1 or between the inner head bolts B2, and a narrow part 14*n* which is located on the front side (on one side in the orthogonal direction A1) relative to the wide part 14*w* and of which the width in the axial direction is smaller than the interval in the axial direction between the outer head bolts B1 or between the inner head bolts B2 (see FIG. 16, also). The wide part 14*w* and the narrow part 14*n* are aligned in the orthogonal direction A1.

The inlet P13*a*, the opening part 15*a*, the camshaft 41 and a rocker shaft 45 are disposed at the wide part 14*w*, whereas valve stems 29*b* (see FIG. 2A) of the exhaust valves 29 and the valve springs 44 of the exhaust valves 29 are disposed at the narrow part 14*n* located between the outer head bolts B1 in the axial direction. In addition, the opening part 15*a* and the inlet P13*a* are opened in the bottom surface 3*s* at respectively a left end part 14*a* and a right end part 14*b* of the wide part 14*w* in the axial direction. As viewed from the cylinder axis direction, the straight line passing through the cylinder axis Ly and being orthogonal to the specified line L1 is taken as a center line L2, whereon the inlet P13*a* is located farther in the axial direction from the center line L2 than the bearing part 35*b* and the narrow part 14*n*, and the opening part 15*a* is located farther in the axial direction from the center line L2 than the bearing part 35*a* and the narrow part 14*n*.

As viewed from the cylinder axis direction, the cam chamber 14 is bisected by the specified straight line L1 passing through the cylinder axis Ly and being orthogonal to the direction (in this embodiment, the front-rear direction, which is the orthogonal direction A) parallel to the front side as the above-mentioned predetermined direction, into a first region 14*f* and a second region 14*r* located on opposite sides in the parallel direction (i.e., the front-rear direction), whereon the inlet P13*a*, the recessed part 3*m*, at least a part of the opening part 15*a*, and the groove 3*n* are disposed in the first region 14*f* on the front side relative to the specified straight line L1, namely, in the region on the front side relative to the cylinder axis Ly. In this embodiment, the specified straight line L1, or the cylinder axis Ly and the straight line orthogonal to the vertical line, are parallel to the vehicle width direction. In addition, the camshaft 41, the valve lifters 42 and the swinging center line Lr are disposed in the second region 14*r*. The first region 14*f* located on the front side relative to the second region 14*r* is located on the more lower side, as compared with the case where the cylinder axis Ly is parallel to the vertical line; therefore, the lubricating oil having lubricated the parts to be lubricated in the cam chamber 14 such as the valve train 40 will easily flow into the inlet P13*a* and the opening part 15*a* located in the first region 14*f*, by flowing over the bottom surface 3*s*.

With reference to the cylinder 2*a*, the pair of intake cam lobes 411 and the pair of exhaust cam lobes 41*e* which are located on the camshaft 41, the pair of valve lifters 42, the pair of rocker arms 43 are located between the pair of bearing parts 35*a*, 35*b* adjacent in the axial direction, namely, on the inner side of the pair of bearing parts 35*a*, 35*b* in the axial direction. On the other hand, the whole of the oil discharge passage P13 and substantially the whole of the opening part 15*a* are located on the outer sides of the pair of bearing parts 35*a*, 35*b* in the axial direction; specifically, as viewed from the cylinder axis direction, the whole of the oil discharge passage P13 is located farther from the center line L2 than the bearing part 35*b*, and substantially the whole of the opening part 15*a* is located farther from the center line L2 than the bearing part 35*a*. Further, in the axial direction, the inlet P13*a* is located nearer to the peripheral wall 3*c* than the bearing part 35*b*, and the opening part 15*a* is located nearer to the peripheral wall 3*c* than the bearing part 35*a*.

The outer head bolts B1 are located on the outside of the cam chamber 14, on the side on which the exhaust valve 29 disposed on the front side as one side in the orthogonal direction A1 is located, with respect to the rotary center lines Lc, La, the intake system 28, the valve lifters 42 and the swinging center line Lr, in the orthogonal direction A1 as the direction orthogonal to the rotary center line La of the camshaft 41, as viewed from the cylinder axis direction. Therefore, each outer head bolts B1 is located nearer to the exhaust valve 29 than the rotary center lines Lc, La, the intake system 28, the valve lifters 42 and the swinging center line Lr, in the orthogonal direction A1.

On the other hand, the lubricating system for the power transmission system constitutes a lubricating system independent from the lubricating system for the internal combustion engine E.

Referring to FIGS. 1 and 2, the lubricating oil is fed into the transmission case 12 through an oil feed port other than an oil feed port for feeding the lubricating oil into an oil pan. In the transmission chamber 12*a*, the lubricating oil forms such an oil level that the gear groups 73, 74 of the transmission M are partly immersed in the lubricating oil, and the gear groups 73, 74 rake up the lubricating oil, whereby the transmission M is lubricated. Further, in the clutch chamber 12*b*, the lubricating oil forms such an oil level that the clutch disks 76 of the clutch C are partly immersed in the lubricating oil, whereby the clutch C is cooled and lubricated. Here, the oil level in the clutch chamber 12*b* is located above the oil level in the transmission chamber 12*a*.

Now, flows of the lubricating oil will be described referring to FIGS. 1 to 14.

Figure 9:
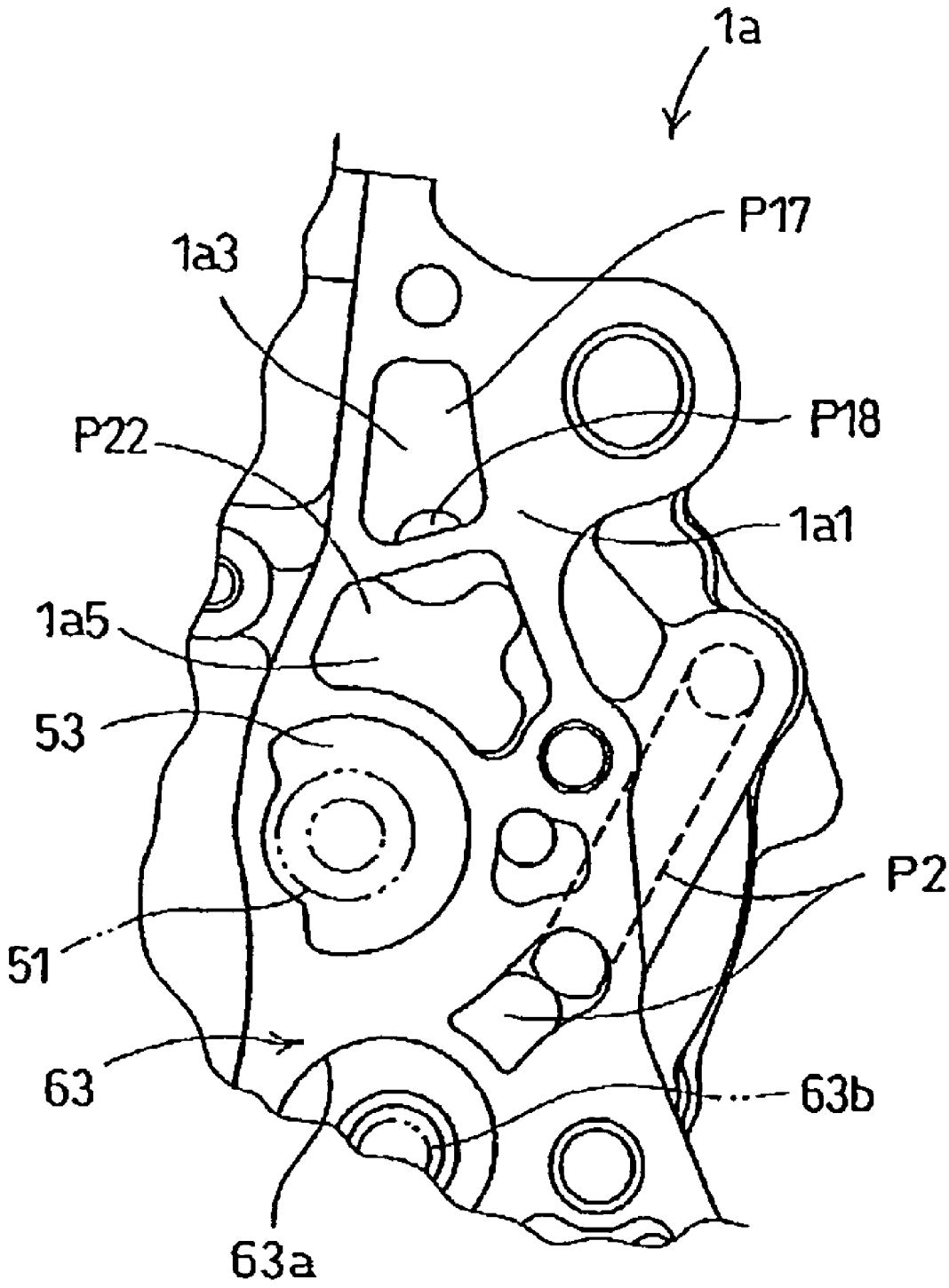
FIG. 9 is a right side detail view of a part of a left case of the crankcase in the internal combustion engine of FIG. 2A.
Figure 10:
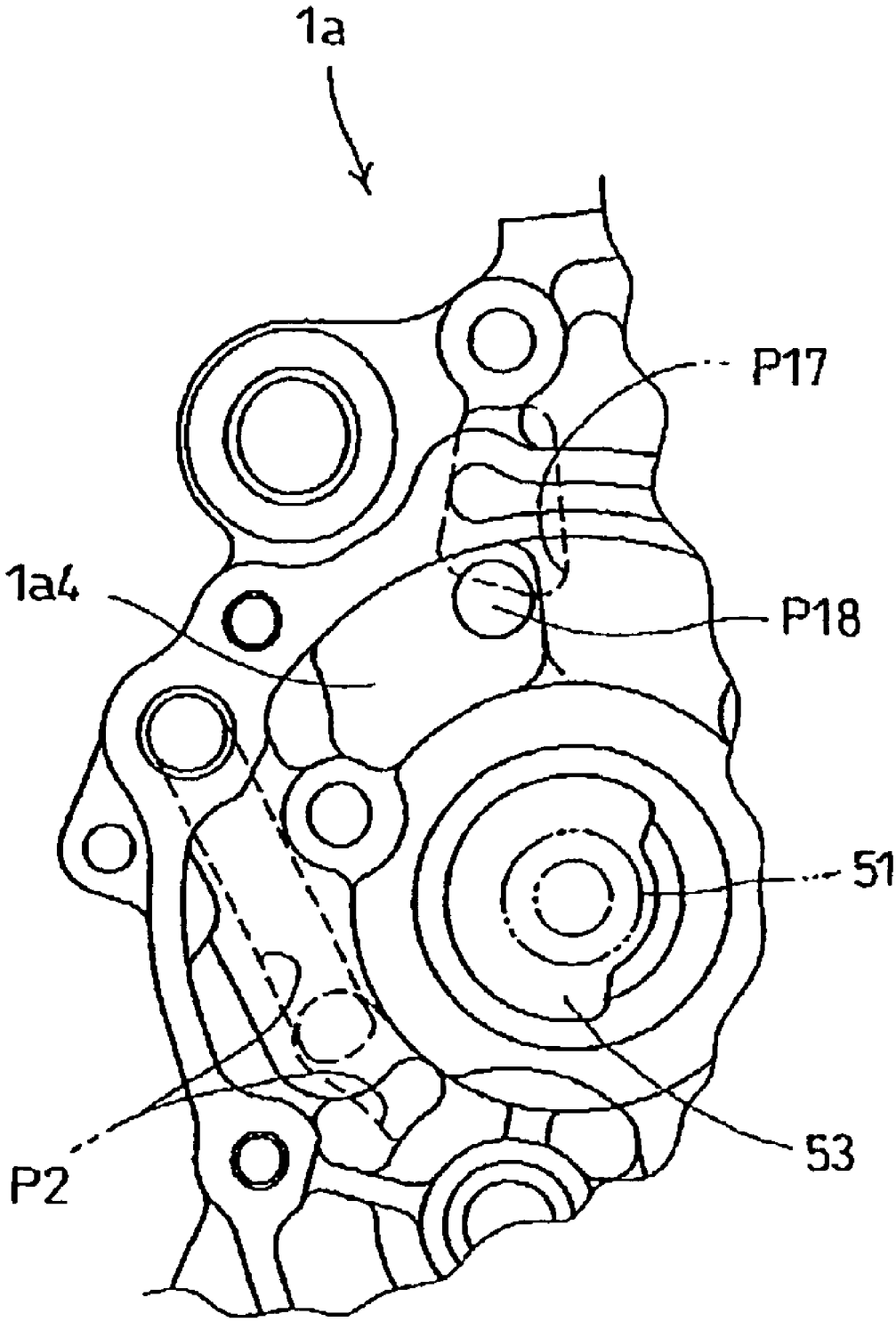
FIG. 10 is a left side detail view of a part of the left case of the crankcase in the internal combustion engine of FIG. 2A.

Referring to FIG. 2A, when the internal combustion engine E is operated and the oil pump 63 is operated, the lubricating oil in the oil reservoir 60 which has been cleaned by the first oil strainer 61*a* and the second oil strainer is sucked into the pump chamber of the oil pump 63 via the suction oil passage P1 and the suction port 65. As shown in FIGS. 9 and 10, the lubricating oil discharged from the pump chamber via the discharge port 66 flows through the discharge oil passage P2 into an oil passage (not shown) which is provided in the left crankcase cover 6 (see FIG. 2) and equipped with an oil filter at an intermediate part thereof. In the left crankcase cover 6, the lubricating oil having passed through the oil filter flows dividedly into an oil passage communicating with the crank chamber oil passage P3 (see FIG. 2) provided in the crankshaft 22 and into an oil passage communicating with the cam chamber oil passage P4 (see FIG. 6) provided in the left case 1*a*.

As shown in FIG. 2, the lubricating oil in the crank chamber oil passage P3 lubricates the bearing 24 for the connecting rod 21, then is jetted into the crank chamber 11, and is supplied to the parts to be lubricated in the crank chamber 11, such as the main bearing 23. The lubricating oil having lubricated the parts to be lubricated flows or drops down in the crank chamber 11, to return to the first oil reservoir 60*a* (see FIG. 2A) in the oil reservoir 60.

Figure 6:
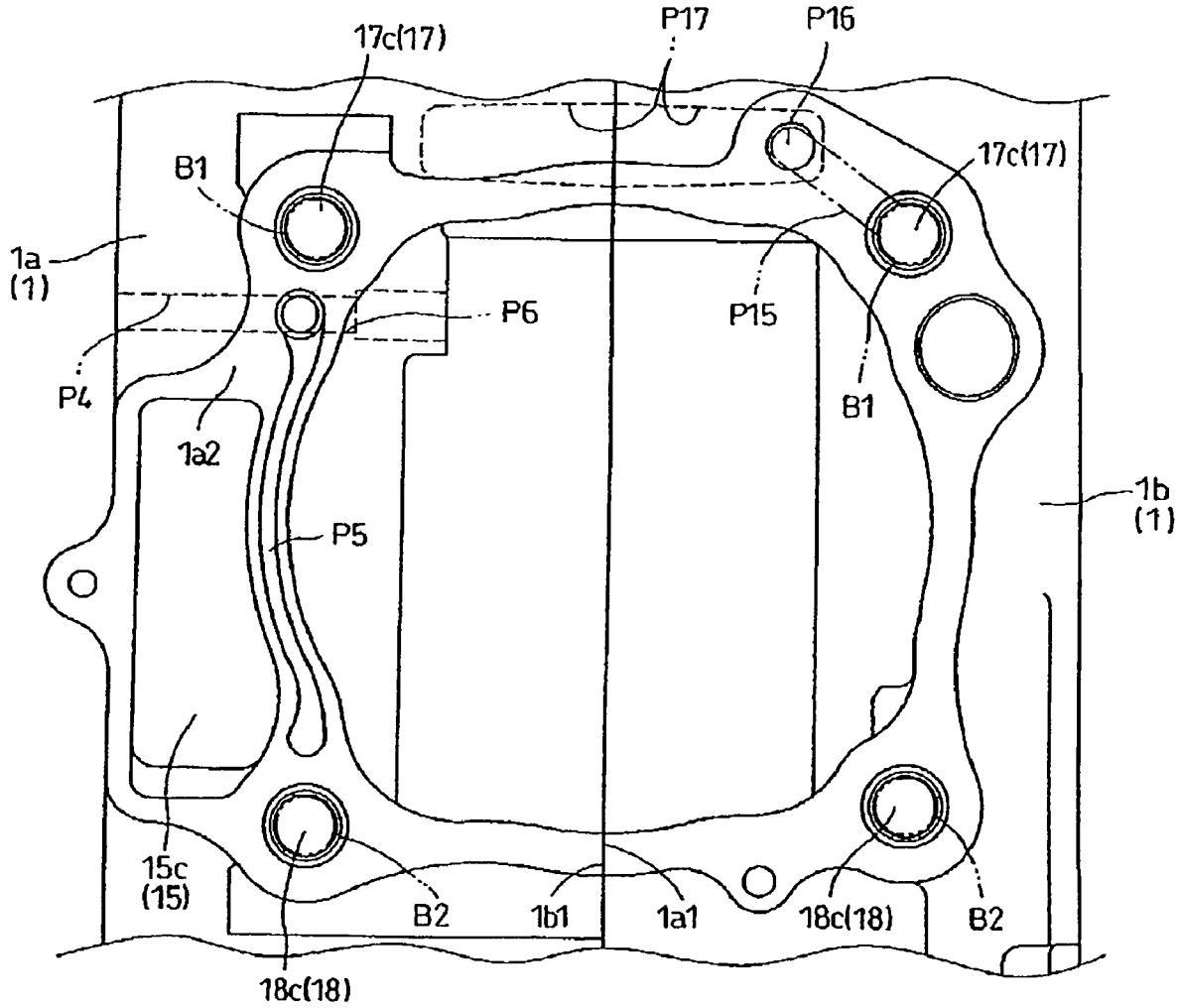
FIG. 6 is a detail view of a part of the crankcase, as viewed along arrows VI-VI of FIG. 2A.

Referring to FIG. 6, the lubricating oil in the cam chamber oil passage P4 is supplied to the parts to be lubricated, such as the valve train 40 (see FIGS. 1 to 3) in the cam chamber 14 formed by the cylinder head 3. For this purpose, the lubricating oil in the cam chamber oil passage P4 flows into an oil passage P5 provided in the connecting surface 1a2, for connection to the cylinder block 2, of the left case 1a. In addition, a portion of the lubricating oil in the cam chamber oil passage P4 is jetted through an oil jet (not shown) attached to an oil passage P6 branched from the cam chamber oil passage P4, toward the back surface of the piston 20.

Figure 5:
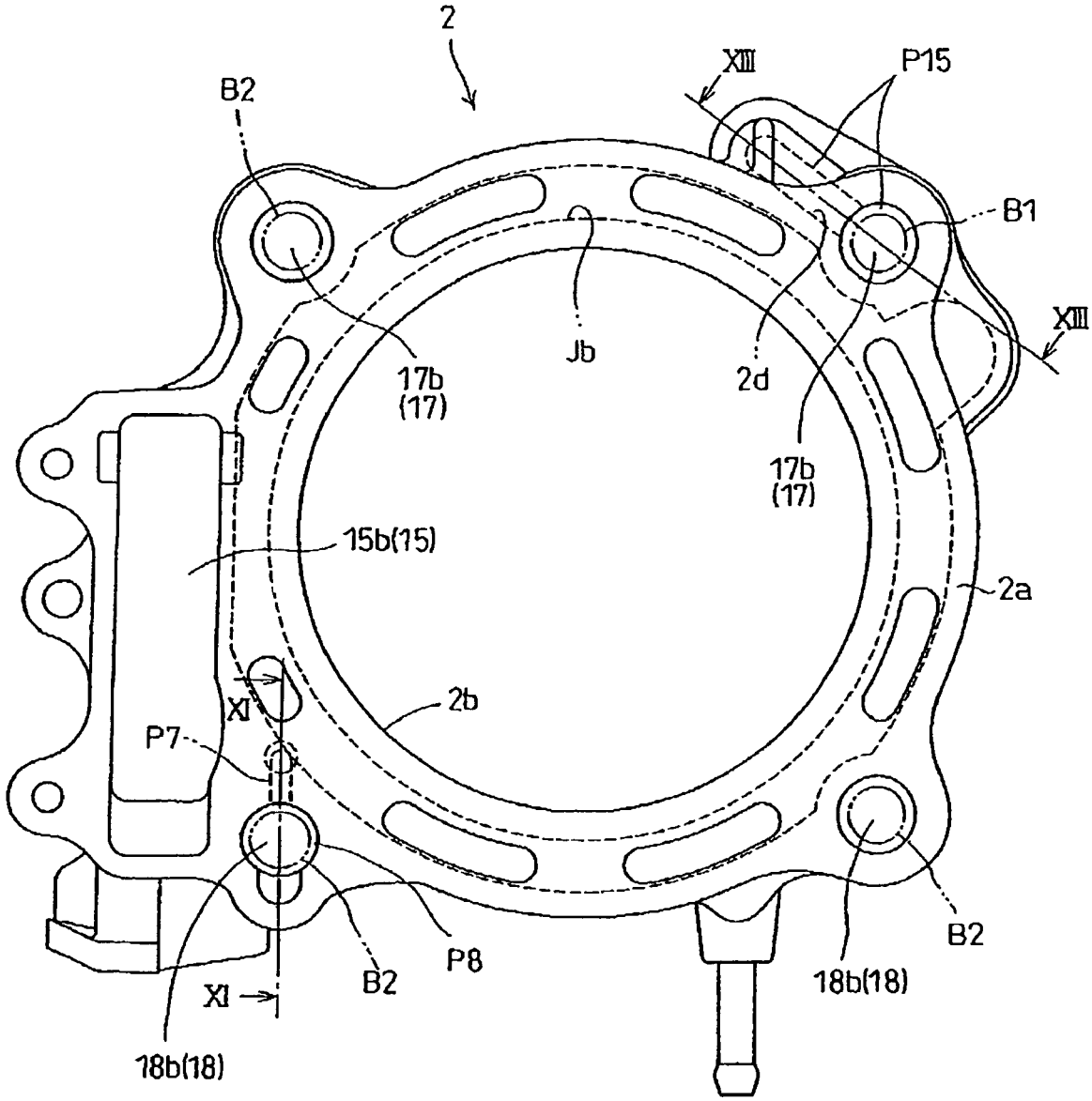
FIG. 5 is a view of the cylinder block, taken along arrows V-V of FIG. 2A.
Figure 11:
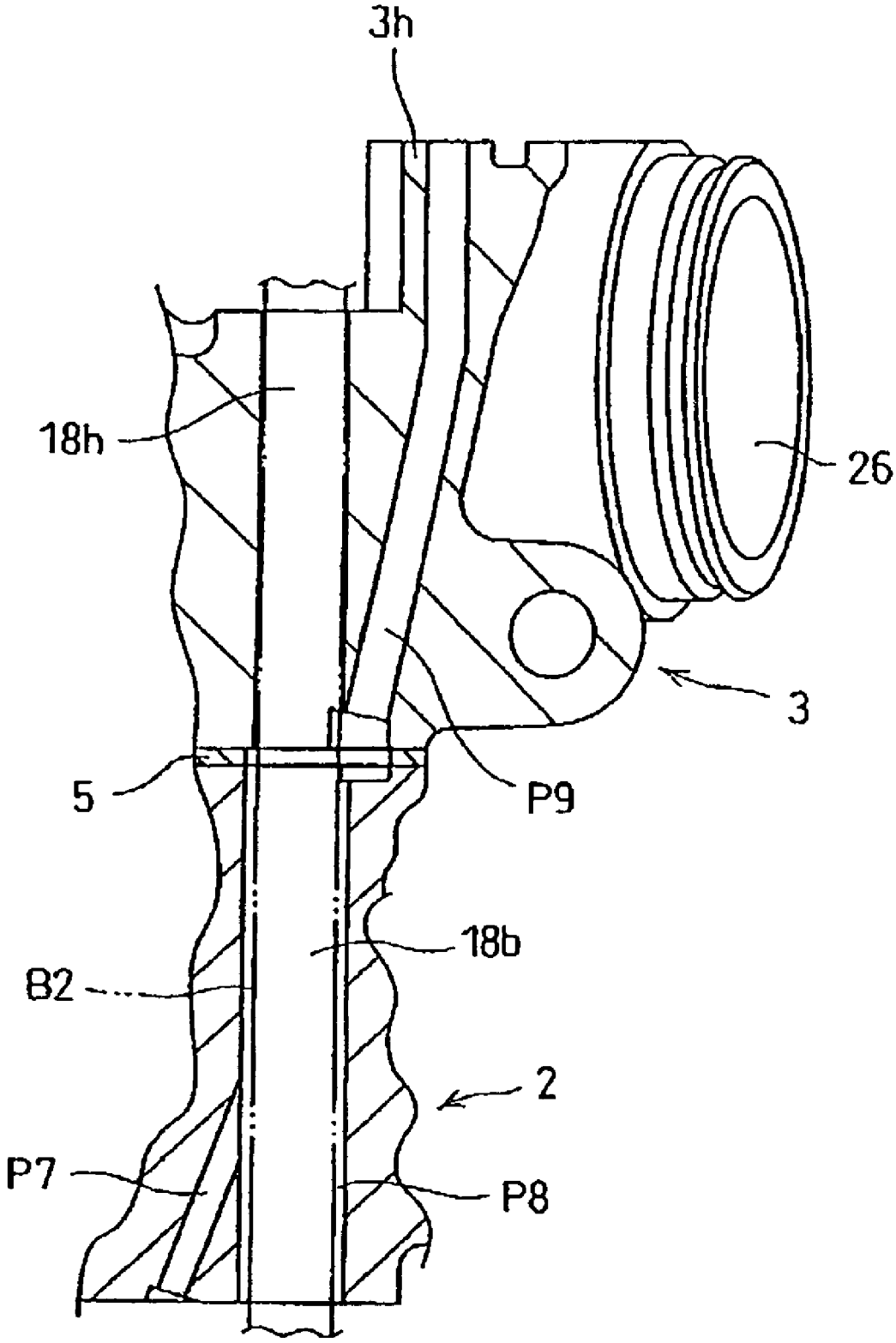
FIG. 11 is a sectional view taken along line XI-XI of FIGS. 4 and 5.

As shown in FIGS. 5 and 11, the lubricating oil in the oil passage P5 flows through an oil passage P7 provided in the cylinder block 2 into a cylinder oil passage P8 including the bolt-receiving hole 18b, flows between the cylinder head 2 and the head bolt B2, and flows through an oil hole provided in the gasket 5 into a head oil passage P9 (see FIG. 4, also) provided in the cylinder head 3.

As shown in FIGS. 3, 4 and 11, the lubricating oil in the head oil passage P9 flows through an oil passage P10 provided in the cam holder 35 connected to an attaching seat 3h provided at the cylinder head 3, into a holder oil passage P11. The lubricating oil in the holder oil passage P11 composed of an bolt-receiving hole into which to insert a bolt B3 for connecting the cam holder 35 to the cylinder head 3 is jetted through a jet port P 12 into the cam chamber 14. The holder oil passage P11 and the jet port P12 are provided at positions which are near the end part 14a, which are on the opposite side of the inlet P13a with reference to the camshaft 41 in the front-rear direction, in the second region 14r, as viewed from the cylinder axis direction, which are nearer to the peripheral wall 3c than the camshaft 41, and which are in the vicinity of the bearing part 35a. The jet port P12 is so formed as to jet the lubricating oil in a direction substantially toward the inlet P13a, as viewed from the cylinder axis direction.

The lubricating oil jetted from the jet port P12 is supplied to the parts to be lubricated in the cam chamber 14 inclusive of the parts to be lubricated of the valve train 40, such as the sliding parts between the intake cam lobes 41i and the valve lifters 42, the sliding parts between the exhaust cam lobes 41e and the rocker arms 43, the bearing 36 (see FIG. 2), the sliding parts between the valve lifters 42 and the holding part 35d, the sliding parts between the rocker arms 43 and the rocker shaft 45 lubricated by the lubricating oil flowing in through an oil hole 43c provided in the rocker arm 43, and the meshing parts between the chain 46c and the cam timing gear 46b.

The lubricating oil in the cam chamber 14 which has lubricated the valve train 40 and other parts to be lubricated in the cam chamber 14 flows over the bottom surface 3s into the timing chamber 15 and the oil discharge passage P13 located respectively at both end parts 14a, 14b in the axial direction (in this embodiment, this is also the vehicle width direction) of the cam chamber 14, as shown in FIGS. 3, 4 and 12.

The lubricating oil in the timing chamber 15, in the course of returning into the second oil reservoir of the oil reservoir 60 through the timing chamber 15, is served to lubrication of the timing chain and gear set 46 by, for example, adhering to the chain 46c so as to lubricate the sliding parts of the chain 46c (see FIG. 2) or to lubricate the meshing parts between the chain 46c and the crank timing gear 46a, then returns into the second oil reservoir in the accessory chamber 13, and flows into the first oil reservoir 60a.

Figure 8:
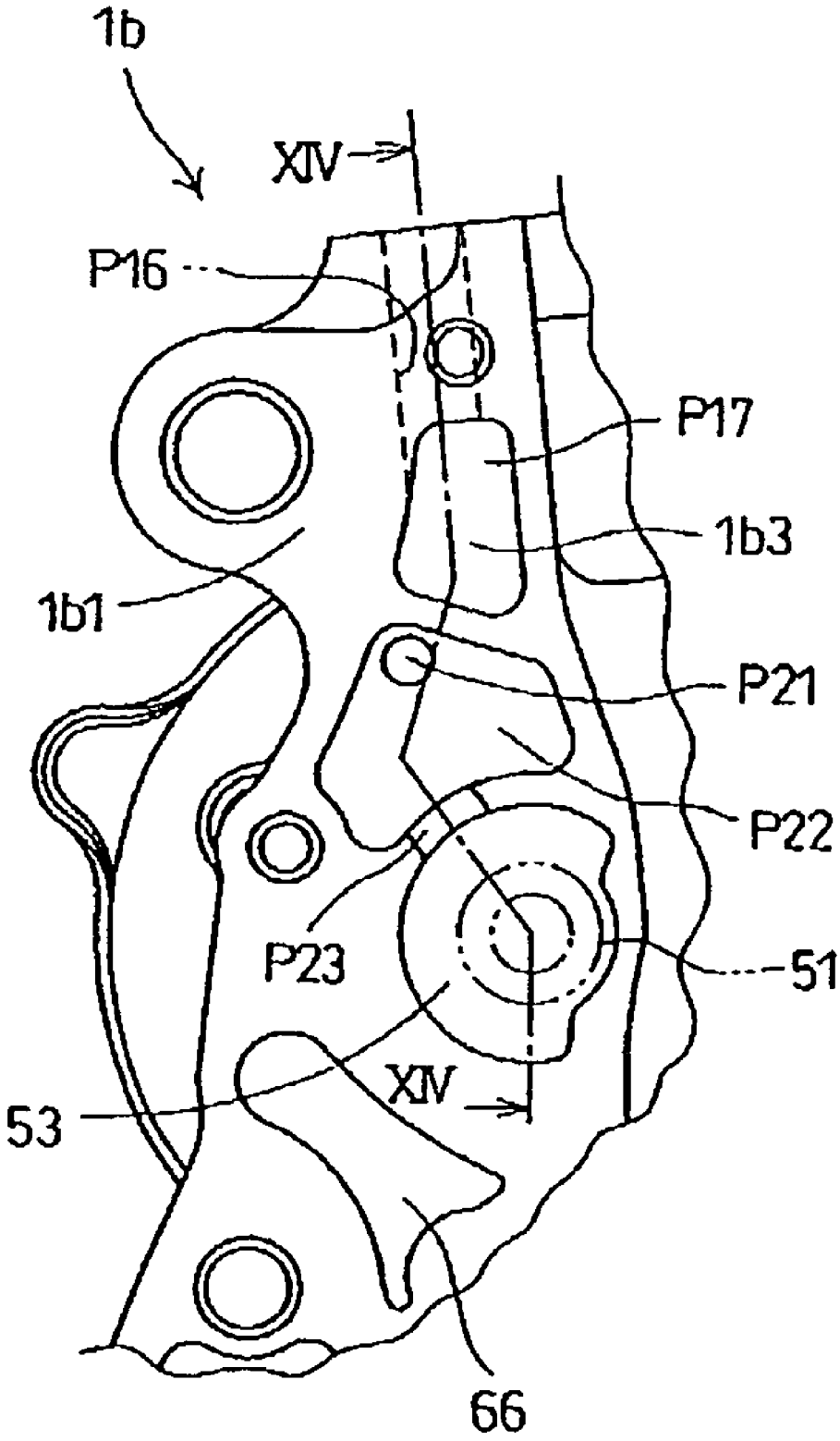
FIG. 8 is a left side detail view of a part of the right case of the crankcase in the internal combustion engine of FIG. 2A.
Figure 13:
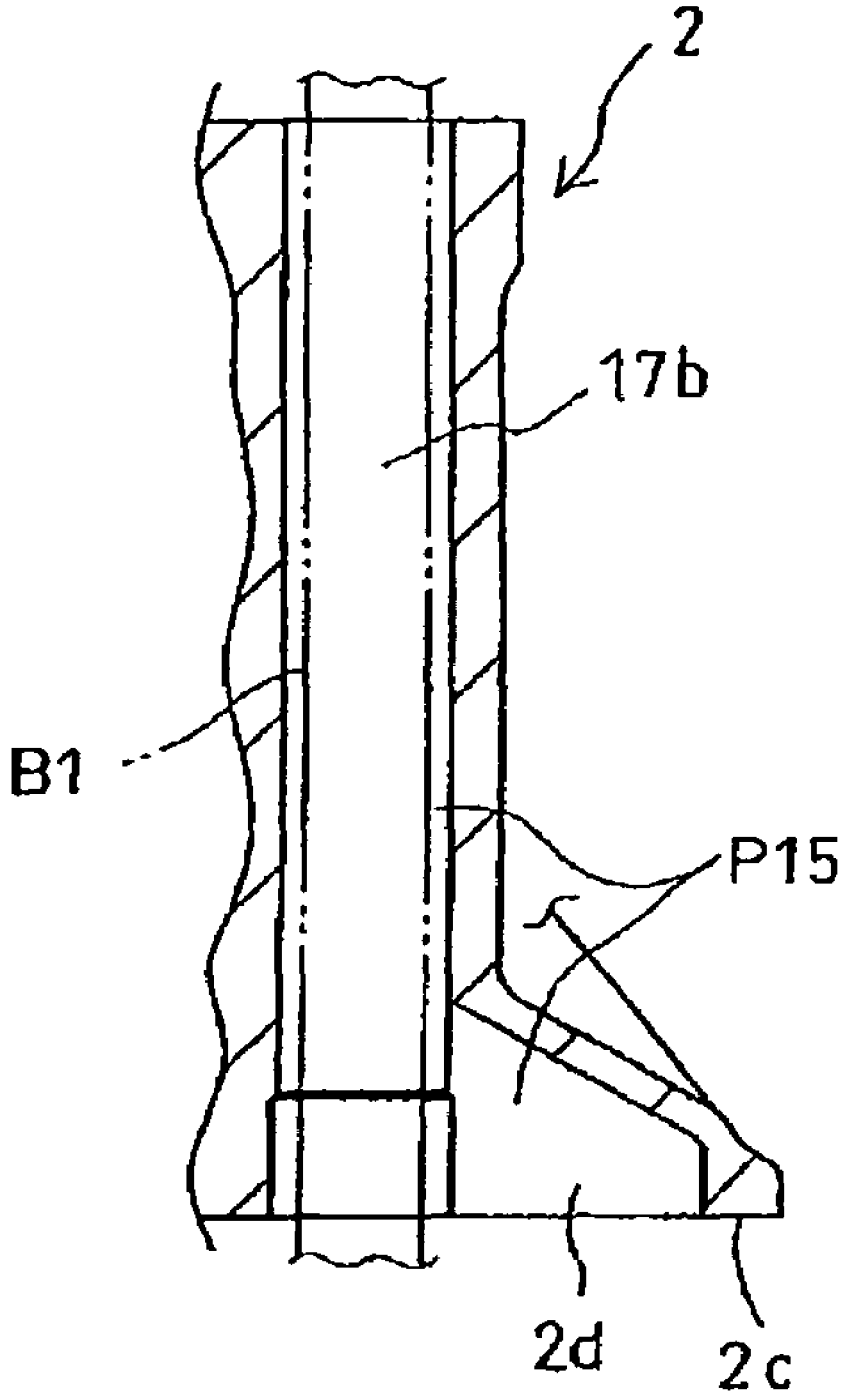
FIG. 13 is a sectional view taken along line XIII-XIII of FIG. 5.

On the other hand, the lubricating oil in the oil discharge passage P13 flows through the outlet P13b into an oil passage P14 composed on the outer bolt-receiving hole 17h1, flows down in the cylinder head 3, flows into an oil passage P15 composed of the bolt-receiving hole 17b and the groove 2d opened in the connecting surface 2c for connection to the right case 1b, as shown in FIGS. 5 and 13, and thereafter flows into an oil passage P16 provided in the right case 1b and opened at the connecting surface 1b2 for connection to the cylinder block 2, as shown in FIGS. 6, 8 and 14.

Referring to FIGS. 6, 8 to 10 and 14, the lubricating oil in the oil passage P16 flows into an enlarged oil passage P17 which is formed in an oil chamber having an inside volume and a passage area made larger than the inside volume and the passage area of the oil passage P16 by a pair of recessed parts 1a3, 1b3 opened in the connecting surfaces 1a1, 1b1 and which extends in a horizontal direction. The lubricating oil in the enlarged oil passage P17 flows through an oil hole P18 provided in the left case 1a into a recessed part 1a4 opened into the accessory chamber 13. The lubricating oil flowing out of the recessed part 1a4 lubricates an accessory driving mechanism 64 composed of a gear mechanism of the oil pump 63 disposed in the accessory chamber 13, and then flows or drops down in the accessory chamber 13, returning into the second oil reservoir of the oil reservoir 60 (in FIG. 14, the flows of the lubricating oil are indicated by arrows).

On the other hand, referring to FIGS. 7 to 10 and 14, in the clutch chamber 12b, of the lubricating oil reserved in the clutch chamber 12b, a portion raked up by the driven gear 50b of the balancer driving mechanism 50 for driving the balance shaft 51 is collected in an oil sump P20 formed by a trough-like recessed part 1b4 provided in the right case 1b and opened in a direction opposite to the rotating direction of the driven gear 50b. The lubricating oil in the oil sump P20 flows through an oil hole P21 provided in the right case 1b into an oil chamber P22 formed by a pair of recessed parts 1a5, 1b5 provided in the left case 1a and the right case 1b and opened in the connecting surfaces 1a1, 1b1, and flows through an oil hole P23 provided in a bottom wall of the oil chamber P22 into the accommodating chamber 53 accommodating the balance shaft 51 (in FIG. 14, the flows of the lubricating oil are indicated by arrows). The lubricating oil in the accommodating chamber 53 provided to range through the left case 1a and the right case 1b is supplied into a left-right pair of bearings 52 (in FIG. 14, the bearing 52 on the left side is shown) for bearing the balance shaft 51, and the lubricating oil having lubricated the bearings 52 returns into the clutch chamber 12b via the right side of the accommodating chamber 53, since the area between the accommodating chamber 53 and the accessory chamber 13 is sealed up with a seal member 54 on the left side of the accommodating chamber 53.

Referring to FIGS. 1, 2, 15 and 16, the internal combustion engine E includes a positive crankcase ventilation system 80 for recirculating a blowby gas into the intake passage of the internal combustion engine E through a breather chamber 81 provided at the cylinder head cover 4. The breather chamber 81 is included of a breather case 82, which is formed as one body with the cylinder head cover 4, and a plate-like partition member 83 connected to the breather case 82 by bolts B5 so as to partition the breather chamber 81 from the cam chamber 14. The breather chamber 81 has an inlet 81a and an outlet 81b for the blowby gas, and a separated lubricating oil discharge port 81c, and the inside of the breather chamber 81 ranging from the inlet 81a to the outlet 81b is formed as a labyrinth-like passage by a multiplicity of baffle plates 84, which is formed integrally with the breather case 82.

The positive crankcase ventilation system 80 ensures that the blowby gas in the crank chamber 11 flows through the timing chamber 15 into the cam chamber 14, and then flows through the inlet 81a into the breather chamber 81. In the breather chamber 81, the blowby gas flows toward the outlet 81b while colliding against the baffle plates 84, whereby the lubricating oil mixed in the blowby gas is separated. Next, the blowby gas from which the lubricating oil has been separated is recirculated into the intake system through a recirculating passage formed by a hose 86 connected to a connection part 85 forming the outlet 81b, and is sucked into the combustion chamber 25 together with the intake gas. On the other hand, the lubricating oil thus separated drops through the discharge port 81*c* into the cam chamber 14, to be supplied to the parts to be lubricated in the cam chamber 14.

Referring to FIGS. 1, 4 and 15 to 17, the internal combustion engine E has a secondary air supply system 90 for supplying clarifying air into the exhaust gas for clarifying the exhaust gas by oxidizing the unburned components such as HC and CO in the exhaust gas. The secondary air supply system 90 includes a reed valve 91 attached to the cylinder head cover 4 and functioning as a control valve for controlling the quantity of air supplied to the exhaust gas, a valve accommodating part 92 accommodating the reed valve 91, an introducing pipe 95 for forming an air introducing passage for leading air from the air cleaner to the reed valve 91, and an air supply passage 96 for leading to the exhaust port 27 the clarifying air having passed through the reed valve 91, which is opened and closed in response to the pressure of the exhaust gas at the exhaust port 27.

The valve accommodating part 92 is included of a valve case 93 formed as one body with the cylinder head cover 4, and a valve cover 94 which is connected to the valve case 93 by bolts B6 screwed into a pair of screw holes 93*a* provided in the valve case 93 and which clamps the reed valve 91 between itself and the valve case 93. The valve case 93 is included of a part, forming the narrow part 14*n* of the cam chamber 14, of the cylinder head cover 4, and, therefore, the valve accommodating part 92 and the reed valve 91 are disposed in a compact form between both the outer head bolts B1 in the axial direction. The valve cover 94 has a connection part 94*a* to which the introducing pipe 95 is connected. The air supply passage 96 includes: a hole 96*a* provided in the cylinder head cover 4 which serves also as the valve case 93; a hole 96*b* provided in a part, forming the narrow part 14*n*, of the cylinder head 3; and a passage composed of a conduit tube 96*c* serving also as a positioning part which is press fitted into the hole 96*a* to thereby position the cylinder head cover 4 relative to the cylinder head 3.

The air supply passage 96 having a rectilinear shape is so located as to be wholly overlapped with the exhaust port 27, as viewed from the cylinder axis direction, and is extended substantially in parallel to the cylinder axis Ly. Therefore, the passage length of the air supply passage 96 can be set short, whereby pressure loss of the clarifying air is reduced, and the performance of clarification of the exhaust gas by the secondary air supply system 90 is enhanced.

Now, the operation and effects of the embodiment configured as above will be described below.

The cylinder head 3 of the internal combustion engine E wherein the valve train 40 is lubricated by the lubricating oil in the cam chamber 14 is provided with the outer bolt-receiving hole 17*h*1 in which a head bolt B1 is inserted and which is not opened into the cam chamber 14, and the oil discharge passage P13 which has the inlet P13*a* opened into the cam chamber 14 and the outlet P13*b* opened into the outer bolt-receiving hole 17*h*1. By utilizing the insertion passage 17*h*1 in which the head bolt B1 is inserted and which is not opened into the cam chamber 14, the oil discharge passage P13 is provided in the cylinder head 3 so as to communicate with the outer bolt-receiving hole 17*h*1, so that the passage length of the oil discharge passage P13 is made short, and it is unnecessary to secure a large space in the cylinder head 3 for the purpose of providing the oil discharge passage P13. Therefore, the oil discharge passage P13 can be easily provided in the area where the lubricating oil is collected in the cam chamber 14, for example, at the end part 14*b* of the cam chamber 14*b*. The lubricating oil in the oil discharge passage P13, finally, returns into the oil reservoir 60 constituting the lubrication system for the internal combustion engine E. As a result, the outer head bolts B1 are not disposed inside the cam chamber 14, and this configuration ensures that while reducing the sizes of the cam chamber 14, the cylinder head 3 and the cylinder head cover 4, the performance of discharge of the lubricating oil present in the cam chamber 14 can be enhanced by the oil discharge passage P13, and the lubricating oil is prevented from collecting in the cam chamber 14.

The cylinder axis Ly is inclined toward the front side which is a predetermined direction relative to the vertical line, and, as viewed from the cylinder axis direction, the cam chamber 14 is bisected into the first region 14*f* and the second region 14*r* in the front-rear direction by the specified straight line L1 passing through the cylinder axis Ly and being orthogonal to the front-rear direction, whereon the inlet P13*a* is disposed in the first region 14*f* on the front side relative to the specified straight line L1. As a result, since the cylinder axis Ly is inclined toward the front side relative to the vertical line, the inlet P13*a* is disposed in the first region 14*f* which is located on the more lower side, as compared with the case where the cylinder axis Ly is parallel to the vertical line; therefore, the lubricating oil on the bottom surface 3*s* in the cam chamber 14 will easily flow into the oil discharge passage P13. As a result, the configuration wherein the cylinder block 2 is disposed so that the cylinder axis Ly is inclined to the predetermined direction relative to the vertical line makes it possible to further enhance the performance of discharge of the lubricating oil present in the cam chamber 14, using a simple structure, without complicating the shape of the bottom wall 3*b* of the head-side chamber wall forming the bottom surface 3*s* of the cam chamber 14.

The camshaft 41 is disposed in the cam chamber 14, the opening part 15*a* of the timing chamber 15 in which the chain 46*c* for transmitting the power of the crankshaft 22 to the camshaft 41 is disposed is opened into the cam chamber 14, the specified straight line L1 is parallel to the vehicle width direction, the inlet P13*a* is disposed at the end part 14*b* on one side in the vehicle width direction of the cam chamber 14, and the opening part 15*a* is disposed at the end part 14*a* on the other side in the vehicle width direction of the cam chamber 14. As a result, the inlet P13*a* of the oil discharge passage P13 and the opening part 15*a* of the timing chamber 15 are located respectively at both end parts 14*a*, 14*b* in the vehicle width direction of the cam chamber 14, so that the performance of discharge of the lubricating oil is enhanced at both end parts 14*a*, 14*b* in the cam chamber 14, even in a four-wheel vehicle or the like vehicle which is less liable to be inclined in the vehicle width direction, as compared with two-wheel vehicles.

The inlet P13*a* is opened into the recessed part 3*m* formed in the bottom surface 3*s*, and the groove 3*n* provided in the bottom surface 3*s* communicates with the opening part 15*a*. This ensures that the lubricating oil having flowed into the recessed part 3*m* is less liable to flow out of the recessed part 3*m* onto the bottom surface 3*s*, even upon inclination or vibration of the internal combustion engine E during running of the vehicle; therefore, the performance of discharge of the lubricating oil through the oil discharge passage P13 is enhanced. In addition, since the groove 3*n* provided in the bottom surface 3*s* communicates with the opening part 15*a*, the lubricating oil over the bottom surface 3*s* is permitted to easily flow through the groove 3*n* into the timing chamber 15, so that the performance of discharge of the lubricating oil through the timing chamber 15 is enhanced.

The camshaft 41 is a single camshaft 41 provided in the valve train 40. The bolt-receiving holes 17*h* of both bolt-receiving holes 17 or both outer head bolts B1 which are disposed in the outside of the cam chamber 14 are laid out in the outside of the cam chamber 14, on the side where the exhaust valves 29 are located with reference to the rotary center line La and the intake valves 28, in the front-rear direction which is a direction A1 orthogonal to the rotary center line La of the camshaft 41, as viewed from the cylinder axis direction. Therefore, this layout is not limited by the camshaft 41. Further, the valve diameter of the exhaust valves 29 or the diameter of the exhaust apertures 27*a* of the exhaust port 27 is set smaller than the valve diameter of the intake valves 28 or the diameter of the intake apertures 26*a* of the intake port 26. This makes it possible to reduce the cam chamber 14 in the vicinity of the exhaust valves 29, and therefore to further reduce the sizes of the cam chamber 14, the cylinder head 3 and the cylinder head cover 4.

In addition, the exhaust valve 29 located near each of the bolt-receiving holes 17*h* or the outer head bolts B1 is driven by the rocker arm 43 to open and close, and this makes it possible to reduce the width in the axial direction of the narrow part 14*n*, as compared with the case where the exhaust valve 29 is driven by a hollow cylindrical valve lifter; this contributes to reduction in size of the cam chamber 14, the cylinder head 3 and the cylinder head cover 4.

Now, as to an embodiment obtained by partly modifying the configuration of the above-described embodiment, the modified configuration will be described below.

An internal combustion engine E may be a multi-cylinder internal combustion engine including a cylinder block 2 having a plurality of cylinders. Depending on the mode of mounting the internal combustion engine E, the rotary center line La of a camshaft 41 may coincide with the front-rear direction.

The internal combustion engine E may be one in which a cylinder head 3 and the cylinder block 2 are formed integrally, or one in which the cylinder block 2 and at least a part of a crankcase 1 are formed integrally.

Each of cam followers for openingly and closingly driving intake valves 28 may be a rocker arm.

A valve train 40 may be of a type wherein its valve driving mechanism includes a camshaft disposed in a crank chamber 11, and a transmission rod such as a push rod for driving the cam follower by being driven by a valve cam on the camshaft, and wherein the transmission rod for transmitting a valve driving force of the valve cam to the cam follower is disposed in the above-mentioned timing chamber. In that case, the transmission rod constituting a part of the valve driving mechanism in the valve train 40 is disposed in the timing chamber opened into the cam chamber 14, as a transmission part.

Where the lubricating oil is used in common in both the lubrication system for the internal combustion engine and the lubrication system for the power transmission system, a configuration may be adopted wherein a communication hole for permitting the oil passage P17 and the oil passage P22 to communicate with each other is provided, whereby a portion of the lubricating oil coming from the oil discharge passage P13 is permitted to flow from the oil passage P17 through the communication hole into the oil chamber P22, and flows further through the oil hole P23 into the accommodating chamber 53, to be utilized for lubrication of the balance shaft 51.

The above-mentioned predetermined direction may be a horizontal direction other than the forward direction, for example, one of the leftward and rightward directions.

The bottom surface 3*s* of the cam chamber 14 may be formed so as to be the lowest in the vicinity of the inlet P13*a* and in the vicinity of the opening part 15*a*. This permits the lubricating oil on the bottom wall 3*b* in the cam chamber 14 to easily flow into the inlet P13*a* or the opening part 15*a*.

The internal combustion engine E may be mounted on a vehicle so that the rotary center line Lc of the crankshaft 22 is set in a direction other than the vehicle width direction (or the left-right direction), and may be used for other use than the vehicle use.

Although the present invention has been described herein with respect to a limited number of presently preferred embodiments, the foregoing description is intended to be illustrative, and not restrictive. Those skilled in the art will realize that many modifications of the preferred embodiment could be made which would be operable. All such modifications, which are within the scope of the claims, are intended to be within the scope and spirit of the present invention.

What is claimed is:

1. An overhead-cam internal combustion engine, comprising:

a crankcase forming a crank chamber for disposing a crankshaft therein;

a camshaft disposed in a cam chamber which is situated above said crank chamber;

a cylinder block having at least one cylinder formed therein defining a cylinder axis;

a cylinder head fastened to said crankcase or to said cylinder block, said cylinder head having intake and exhaust valves reciprocally mounted therein;

a head bolt extending between said cylinder head and said crankcase or said cylinder block, a cylinder head cover connected to said cylinder head; and a valve actuating mechanism comprising a camshaft for selectively operating said intake and exhaust valves in said cylinder head; said valve actuating mechanism being lubricated with lubricating oil in a cam chamber defined between said cylinder head and said cylinder head cover, wherein said cylinder head is provided with an outer bolt-receiving hole in which said head bolt is inserted, and which is situated outside of said cam chamber, and said cylinder head is further provided with an oil discharge passage having an inlet opening into said cam chamber, and an outlet opening into said outer bolt-receiving hole.

2. The overhead-cam internal combustion engine according to claim 1, wherein the cylinder axis of said cylinder is inclined at an angle in a predetermined direction relative to a vertical line, and wherein said inlet of said oil discharge passage is disposed on the side of a direction of incline with respect to said cylinder axis.

3. The overhead-cam internal combustion engine according to claim 2, wherein said engine is mounted in a vehicle, wherein said camshaft is disposed in said cam chamber and rotatably supported by said cylinder head, and wherein an opening part of a timing chamber, for housing an endless loop member provided for transmitting power of said crankshaft to said camshaft, is opened into said cam chamber, said predetermined direction is the forward direction, said inlet of said oil discharge passage is disposed at an end part on one side of said cam chamber in the vehicle width direction, and said opening part is disposed at an end part on the other side of said cam chamber in said vehicle width direction.

4. The overhead-cam internal combustion engine according to claim 3, wherein said camshaft is a single camshaft provided in said valve actuating mechanism while being rotatably supported by said cylinder head, and said outer bolt-receiving hole is disposed on a side on which said exhaust valve is located, relative to a rotational axis of said camshaft and said intake valve, in a direction orthogonal to said rotational axis, as viewed from the cylinder axis direction.

5. The overhead-cam internal combustion engine according to claim 2, wherein said camshaft is a single camshaft provided in said valve actuating mechanism while being rotatably supported by said cylinder head, and said outer bolt-receiving hole is disposed on a side on which said exhaust valve is located, relative to a rotational axis of said camshaft and said intake valve, in a direction orthogonal to said rotational axis, as viewed from the cylinder axis direction.

6. The overhead-cam internal combustion engine according to claim 1, wherein said camshaft is a single camshaft provided in said valve actuating mechanism while being rotatably supported by said cylinder head, and said outer bolt-receiving hole is disposed on a side on which said exhaust valve is located, relative to a rotational axis of said camshaft and said intake valve, in a direction orthogonal to said rotational axis, as viewed from the cylinder axis direction.

7. The overhead-cam internal combustion engine of claim 1, wherein the outlet of said oil discharge passage is situated at a level disposed below the inlet thereof.

8. The overhead-cam internal combustion engine of claim 7, wherein the oil discharge passage slopes downwardly as it extends from the inlet in the cam chamber to the outlet thereof.

9. A four-wheeled vehicle, comprising:

a frame having a front end and a rear end;

four wheels operatively attached to the frame;

an overhead-cam engine mounted on the frame, said engine comprising:

a crankcase forming a crank chamber for disposing a crankshaft therein;

a cylinder block having at least one cylinder formed therein defining a cylinder axis;

a cylinder head fastened to said crankcase or to said cylinder block by a head bolt, said cylinder head having intake and exhaust valves reciprocally mounted therein;

a cylinder head cover connected to said cylinder head; and a valve actuating mechanism comprising a camshaft for selectively operating said intake and exhaust valves in said cylinder head; said valve actuating mechanism being lubricated with a lubricating oil in a cam chamber defined between said cylinder head and said cylinder head cover, wherein said cylinder head is provided with a bolt-receiving hole in which said head bolt is inserted, and which is situated outside of said cam chamber, and said cylinder head is further provided with an oil discharge passage having an inlet opening into said cam chamber, and an outlet opening into said bolt-receiving hole.

10. The four-wheeled vehicle according to claim 9, wherein the cylinder axis of said cylinder is inclined at an angle in a predetermined direction relative to a vertical line, and said inlet of said oil discharge passage is disposed on the side of a direction of incline with respect to said cylinder axis.

11. The four-wheeled vehicle according to claim 10, wherein said camshaft is disposed in said cam chamber and rotatably supported by said cylinder head, and wherein an opening part of a timing chamber in which to dispose an endless loop member for transmitting power of said crankshaft to said camshaft is opened into said cam chamber, said predetermined direction is the forward direction, said inlet of said oil discharge passage is disposed at an end part on one side of said cam chamber in the vehicle width direction, and said opening part is disposed at an end part on the other side of said cam chamber in said vehicle width direction.

12. The four-wheeled vehicle according to claim 9, wherein said camshaft is a single camshaft provided in said valve actuating mechanism while being rotatably supported by said cylinder head, and said bolt-receiving hole is disposed on a side of the cylinder head on which said exhaust valve is located, relative to a rotational axis of said camshaft and said intake valve, in a direction orthogonal to said rotational axis, as viewed from the cylinder axis direction.

13. The four-wheeled vehicle of claim 9, wherein the outlet of said oil discharge passage is situated at a level disposed below the inlet thereof.

14. The four-wheeled vehicle of claim 9, wherein the oil discharge passage slopes downwardly as it extends from the inlet in the cam chamber to the outlet thereof.

15. A cylinder head comprising:

a cylinder head body having a cam mounting surface formed thereon for operatively supporting a camshaft, said cylinder head body having a raised peripheral wall extending around said cam mounting surface for supporting a cylinder head cover thereon, said raised peripheral wall defining a portion of a cam chamber therein, said cylinder head body further having an outer bolt-receiving hole formed therethrough to receive a head bolt, wherein said outer bolt-receiving hole is disposed outside of said raised peripheral wall, said cylinder head body also having an oil discharge passage formed therein and extending between an inlet disposed inside of the raised peripheral wall and an outlet opening into and in fluid communication with said outer bolt-receiving hole, where the outlet of said oil discharge passage is situated at a level disposed below the inlet thereof.

16. The cylinder head according to claim 15, wherein an opening part of a timing chamber, for housing an endless loop member provided for transmitting power of a crankshaft to said camshaft, is opened into said cam chamber, wherein said inlet of said oil discharge passage is disposed at an end part at a first side of said cam chamber, and wherein said opening part is disposed at an end part on at a second side of said cam chamber substantially opposite said first side.

17. The cylinder head according to claim 15, wherein said cylinder head body also has an exhaust port formed therein, and wherein said head bolt-receiving hole is disposed on a side of said cylinder head proximate said exhaust port.

18. The cylinder head according to claim 15, wherein the outlet of said oil discharge passage is situated at a level disposed below the inlet thereof.

19. The cylinder head according to claim 18, wherein the oil discharge passage slopes downwardly as it extends from the inlet to the outlet thereof.

* * * * *